US009022535B2

(12) United States Patent
Zeng et al.

(10) Patent No.: US 9,022,535 B2
(45) Date of Patent: May 5, 2015

(54) INKJET PRINTERS, INK STREAM MODULATORS, AND METHODS TO GENERATE DROPLETS FROM AN INK STREAM

(75) Inventors: Jun Zeng, Sunnyvale, CA (US); Michael H. Lee, San Jose, CA (US); Henryk Birecki, Palo Alto, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1324 days.

(21) Appl. No.: 12/840,083

(22) Filed: Jul. 20, 2010

(65) Prior Publication Data

US 2012/0019604 A1 Jan. 26, 2012

(51) Int. Cl.

| | |
|---|---|
| ***B41J 2/02*** | (2006.01) |
| ***B41J 2/07*** | (2006.01) |
| ***B41J 2/03*** | (2006.01) |

(52) U.S. Cl.

CPC .... *B41J 2/03* (2013.01); *B41J 2/02* (2013.01); *B41J 2002/022* (2013.01)

(58) Field of Classification Search

CPC ..... B41J 2/02; B41J 2/35; B41J 2002/033
See application file for complete search history.

(56) References Cited

U.S. PATENT DOCUMENTS

| | | | |
|---|---|---|---|
| 3,373,437 | A | 3/1968 | Sweet et al. |
| 4,928,113 | A | 5/1990 | Howell et al. |
| 6,863,385 | B2 | 3/2005 | Jeanmaire et al. |
| 2003/0202054 | A1 | 10/2003 | Jeanmaire et al. |
| 2009/0046129 | A1 | 2/2009 | Hawkins et al. |
| 2009/0153627 | A1 | 6/2009 | Barbet |
| 2010/0258205 | A1 * | 10/2010 | Hawkins et al. ..... 137/511 |

FOREIGN PATENT DOCUMENTS

| | | | |
|---|---|---|---|
| WO | 2009004280 | A1 | 1/2009 |
| WO | 2009004318 | A1 | 1/2009 |
| WO | 2010028712 | A1 | 3/2010 |

OTHER PUBLICATIONS

P.R. Chiarot and T. B. Jones, "Dielectrophoretic Deflection of Ink Jets," J. Micromech. Microeng. 19 (2009) 125018, 8 pages.

R. Ahmed and T. B. Jones, "Dispensing Picoliter Droplets on Substrates Using Dielectrophoresis," Journal of Electrostatics, 2005, 7 pages.

J. Zeng and F. T. Korsmeye, "Principles of Droplet Electrohydrodynamics for Lab-On-A-Chip," Lab Chip, 2004, pp. 265-277.

DALSA: Semiconductor & MEMS Foundry, retrieved from http://www.dalsa.com/semi/technology/hvcmos.aspx, 2 pages.

Wilk et al., "Teflon-Coated Silicon Apertures for Supported Lipid Bilayer Membranes," Applied Physics Letters, vol. 85, No. 15, Oct. 11, 2004, 3 pages.

(Continued)

*Primary Examiner* — Stephen Meier
*Assistant Examiner* — Renee I Wilson
(74) *Attorney, Agent, or Firm* — Hanley Flight & Zimmerman

(57) ABSTRACT

Ink jet printers, ink stream modulators, and methods to generate droplets from an ink stream are disclosed. An example method to generate droplets from an ink stream includes generating a stream of ink with an inkjet nozzle and modulating the stream of ink into a plurality of droplets by generating an alternating electrical field having a frequency based on a permittivity of the ink to cause a dielectrophoretic effect.

20 Claims, 12 Drawing Sheets

(56) References Cited

OTHER PUBLICATIONS

Technical Bulletin: Kodak Versamark Stream Inkjet Technoloby Inks and Fluids Environmental Statement, Mar. 2009, retrieved from http://graphics.kodak.com/KodakGCG/uploadedFiles/stream%20ink%20environmental%20statement_1USA.pdf, 1 page.

Richard G. Sweet, "High Frequency Recording with Electrostatically Deflected Ink Jets," The Review of Scientific Instruments, vol. 36, No. 2, Feb. 1965, 6 pages.

* cited by examiner

INKJET PRINTERS, INK STREAM MODULATORS, AND METHODS TO GENERATE DROPLETS FROM AN INK STREAM

BACKGROUND

Traditionally, digitally controlled ink printing is accomplished using one of two technologies: drop-on-demand or continuous-jetting. Drop-on-demand printing typically utilizes a pressurization actuator to expel an ink jet droplet at desired times onto a print substrate. Continuous-jetting printing generally produces a continuous stream of ink. Some of the ink produced in continuous-jetting is then removed from the stream to control the placement of the ink on a print substrate.

DETAILED DESCRIPTION

Figure 1:
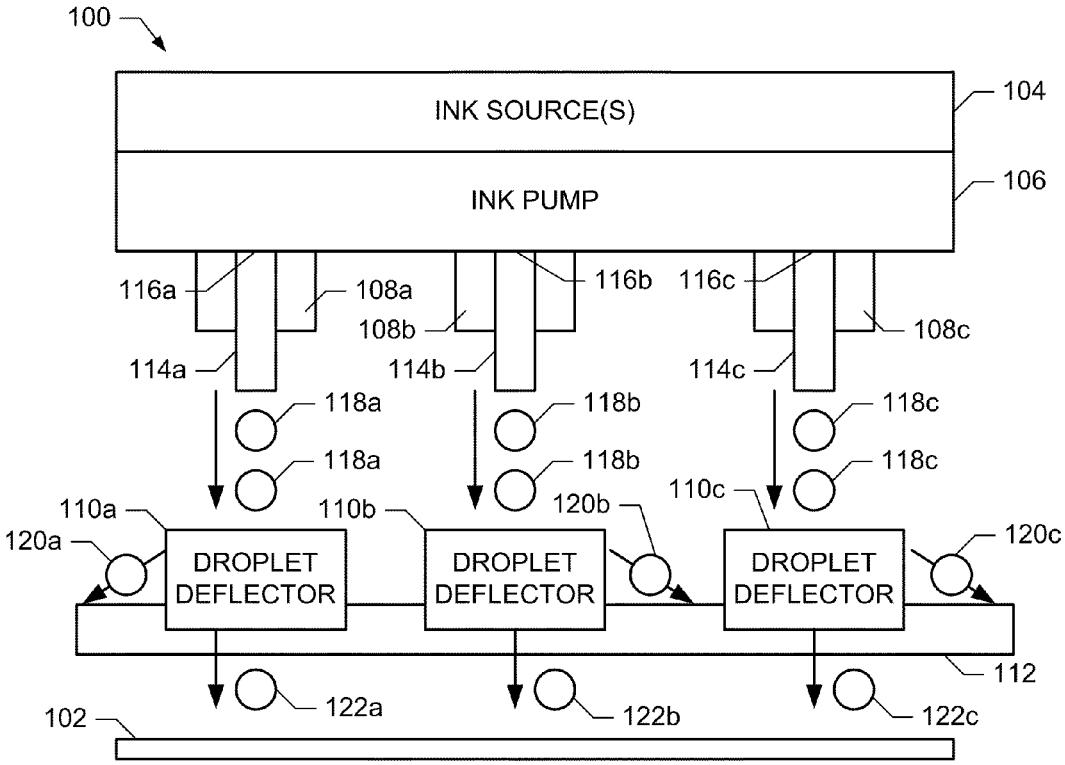
FIG. 1 is a block diagram of an example continuous-jetting printer constructed in accordance with the teachings of this disclosure.

Certain examples are shown in the above-identified figures and described in detail below. In describing these examples, like or identical reference numbers are used to identify the same or similar elements. Additionally, several examples have been described throughout this specification. Any feature(s) from any example may be included with, a replacement for, or otherwise combined with, other features from other examples. The figures are not necessarily to scale and certain features and certain views of the figures may be shown exaggerated in scale or in schematic for clarity and/or conciseness. Although the following discloses example systems and apparatus, it should be noted that such systems and apparatus are merely illustrative and should not be considered as limiting the teachings of this disclosure.

In the field of inkjet printing, continuous-jetting is a method used to deliver ink to a print substrate at a higher rate than drop-on-demand printing, resulting in higher print throughput. Continuous-jetting printers generate a substantially continuous stream of ink from one or more ink nozzles. The stream of ink is then broken into individual drops of ink. Individual drops are then selectively removed from the series of drops generated from the stream. The drops that are not removed land on the print substrate to form the image. As referred to herein, continuous-jetting is the generation of one or more continuous or substantially continuous jets or streams of ink from one or more respective nozzles during a printing task. The continuous-jetting may be paused and/or stopped when not performing a printing task or at any other appropriate times.

The example methods, apparatus, and articles of manufacture described herein may be used to generate discrete droplets from a stream of ink, such as a stream of ink generated during continuous-jetting printing. In some examples, a printer generates a stream of ink traveling toward a print substrate through a nozzle. The example stream of ink may be continuous or substantially continuous for the duration of a print task that includes generating an image on one or more print substrates.

To control the placement of the ink on the print substrate, some example methods, apparatus, and articles of manufacture disclosed herein generate discrete droplets from the stream of ink by generating an alternating electrical field, which applies a dielectrophoretic force to the stream. Dielectrophoresis is the lateral motion imparted on an uncharged discrete material (e.g., ink) that is immersed in an electrically different, substantially continuous medium (e.g., air) as a result of polarization induced by non-uniform electric fields. Dielectrophoretic force is dependent on the magnitude and degree of non-uniformity of the applied electric field. The polarity of the force depends on the polarity of field non-uniformity and the strength of the induced dipole moment, which is based on the conductivity and permittivity of the discrete medium and the permittivity of the surrounding substantially continuous medium. The electrical field has a first frequency based on the properties of the ink in the stream, and may be modified to accommodate virtually any type of ink. In contrast to known continuous-jetting systems, the example methods, apparatus, and articles of manufacture described herein may accommodate a larger number of different types of inks without suffering substantial performance loss. The methods, apparatus, and articles of manufacture described herein may use, for example, water-based and/or solvent-based inks, and/or may print on different types of print substrates used in combination with the different types of inks. Accordingly, the example methods, apparatus, and articles of manufacture used herein may be used to perform continuous-jetting printing tasks using a larger number of different types of print substrates than known continuous-jetting printing systems. Additionally or alternatively, the dielectrophoretic force may be applied in one or more directions.

As noted above, the AC electrical field has a first frequency which is selected based on the ink being employed. In some examples, the dielectrophoretic force is selectively activated and deactivated at a second frequency. The second frequency is different than the first frequency and is based on a desired ink droplet size. Some example methods, apparatus, and articles of manufacture use an alternating current (AC) power source coupled to multiple electrodes positioned around a stream of ink to generate an alternating electrical field. Some example dielectrophoretic forces result from the generation of an alternating electrical field having a gradient vector proximate to the stream of ink. While in some examples a dielectrophoretic force is activated and deactivated in one direction, in some other examples multiple dielectrophoretic forces in different directions are alternated to decrease the length of the stream prior to breaking into discrete droplets and after exiting the nozzle. As used herein, the "direction" of a dielectrophoretic force refers to the direction of a net vector of dielectrophoretic forces on a stream of ink. Accordingly, a first electrical field may generate a net dielectrophoretic force vector in a first direction, and a second electrical field having a different field gradient may generate a net dielectrophoretic force vector in a second direction.

Some example methods, apparatus, and articles of manufacture described herein include a droplet deflector to deflect one or more droplets modulated from a continuous-jetting stream of ink to prevent the deflected droplet from reaching the print substrate. The example droplet deflector may therefore control which of a series of droplets traveling toward the print substrate reaches the print substrate to form the image. In some example methods, apparatus, and articles of manufacture, the droplet deflector includes a charge emitter to selectively charge the droplets and a charge deflector to deflect the droplets charged by the charge emitter. In some examples, either or both of the droplet size and/or the droplet deflection are based on raster data representative of a desired image to be produced on a print substrate.

Some example droplet deflectors include a droplet sensor to provide feedback and/or error detection to the droplet deflector. In some examples, the droplet sensor is used to compare times when droplets are expected to times when droplets are detected. If a substantial difference exists between the expected and actual droplet times, the droplet deflector may detect an error. In some examples, the droplet sensor detects the droplet size and compares the sizes of detected droplets and the expected sizes of the droplets based on raster data from a rasterizer. Because an incorrect droplet size may negatively affect print quality, in some examples the droplet deflector may detect an error if the detected droplet size is substantially different from a detected droplet size.

In contrast to known droplet deflection devices such as blown air devices that generate an airflow to deflect smaller droplets, the droplet deflector maintains a higher print quality because the non-deflected droplets are substantially or completely unaffected by the droplet deflector. Additionally, example combinations of the dielectrophoretic modulators and the droplet deflectors described herein produce prints having higher print image quality, higher throughput, and larger range(s) of ink and print substrate choices than known continuous-jetting print systems.

As used herein, the term "print quality" may refer to subjective and/or objective qualities of a print generated by applying ink to a print substrate. Example objective qualities that may increase print quality include an accuracy of the application of ink to the substrate, droplet size accuracy, etc. For example, a sharpness of an edge may be increased by reducing the ink droplet size, increasing the application of the ink droplets along the edge, and/or increasing an alignment of the ink droplets along the edge, thereby also increasing a subjective print quality. Subjective print quality refers to personal preferences, perceptions, and/or qualities that are in the eye of the beholder. While some objective qualities, such as accuracy of print color, may also affect a subjective print quality, the example methods, apparatus, and articles of manufacture may not necessarily control or affect these other qualities.

FIG. 1 is a block diagram of an example continuous-jetting printer 100. The example printer 100 may be used to provide high-throughput printing of ink onto a print substrate 102 to form desired images, print, and/or other visual representations. The example printer 100 includes one or more ink source(s) 104, one or more ink pump(s) 106, dielectrophoresis modulators 108*a*, 108*b*, and 108*c*, droplet deflectors 110*a*, 110*b*, and 110*c*, and a discard container 112. In operation (e.g., while printing ink onto a substrate 102), the example printer 100 generates substantially continuous streams 114*a*, 114*b*, and 114*c* or jets of ink from respective nozzles 116*a*, 116*b*, and 116*c*, which are modulated into respective series of discrete ink droplets 118*a*, 118*b*, and 118*c* by respective ones of the dielectrophoresis modulators 108*a*-108*c*.

The example ink pump(s) 106 may be piezoelectric ink pump(s) that generate the substantially continuous streams 114*a*-114*c* of ink (e.g., from the ink source(s) 104) through the nozzles 116*a*-116*c*. However, other methods and/or devices may be used to urge ink through the nozzles 116*a*-116*c* toward the print substrate 102 at a sufficient velocity. In some examples, a single ink pump 106 urges the streams 114*a*-114*c* from the nozzles 116*a*-116*c* toward the print substrate at a velocity of about 10 meters per second (m/s). However, the ink pump 106 may generate the streams 114*a*-114*c* at different velocities based on the distance between the nozzles 116*a*-116*c* and the print substrate 102, the type of ink used, the type of print substrate 102 used, and/or selected or specified print quality.

The example printer 100 may be configured to reduce a distance between the nozzles 116*a*-116*c* and the print substrate 102. For example, the nozzles 116*a*-116*c* may be positioned less than about 1 millimeter from the print substrate 102 to increase the accuracy of the ink deposit position on the print substrate 102 and, thus, to increase the print quality.

As described in more detail below, each of the dielectrophoresis modulators 108*a*, 108*b*, 108*c* generates an electrical field that exerts or applies a dielectrophoretic force $F_{DEP}$ on its respective stream 114*a*, 114*b*, 114*c*. Each generated electrical field is based on the properties (e.g., the permittivity, the conductivity) of the ink used to generate the respective stream 114*a*, 114*b*, 114*c*. In some examples, the modulator 108*a*, 108*b*, 108*c* activates and deactivates its corresponding dielectrophoretic force $F_{DEP}$ to generate droplets 118*a*, 118*b*, 118*c* from the stream 114*a*, while in other examples the modulator 108*a*, 108*b*, 108*c* alternates the direction of the dielectrophoretic force $F_{DEP}$ to generate the droplets 118*a*, 118*b*, 118*c*. By adjusting the frequency of activation and deactivation of the electrical field, the modulator 108*a*, 108*b*, 108*c* may adjust a size of the corresponding droplets 118*a*, 118*b*, 118*c* according to a raster or other print pattern to obtain the desired image on the print substrate 102.

After the modulator 108*a*, 108*b*, 108*c* generates the droplets 118*a*, 118*b*, 118*c* from the corresponding stream 114*a*, 114*b*, 114*c*, the droplet deflector 110*a*, 110*b*, 110*c* deflects one or more of the droplets 118*a*, 118*b*, 118*c* to prevent deflected droplets 120*a*, 120*b*, 120*c* from reaching the print substrate 102. In some examples, the deflected droplets 120*a*, 120*b*, 120*c* are directed to the discard container 112. The discard container 112 collects deflected droplets 120*a*, 120*b*, and 120*c* for later recycling and/or disposal. Non-deflected droplets 122*a*, 122*b*, and 122*c* pass through the droplet deflectors 110*a*-110*c* relatively or completely unaffected and land on the print substrate 102 at positions substantially corresponding to a desired print image.

In some examples, the ink nozzles 116*a*-116*c* direct the respective ink streams 114-114*c* toward particular locations and the print substrate 102 passes through the path of the ink streams 114*a*-114*c*. The deflected droplets 120*a*-120*c* and the non-deflected droplets 122*a*-122*c* are selected and/or deflected to cause droplets 118*a*-118*c* to land on the print substrate 102. In the example of FIG. 1, a print substrate feeder (not shown) feeds the print substrate 102 through the printer 100 such that the print substrate 102 traverses below the nozzles 116*a*-116*c* (e.g., arranged in a print bar). While the example print substrate 102 travels below the nozzles 116*a*-116*c*, the example printer 100 may be configured and/or oriented such that the nozzles 116*a*-116*c* direct the ink streams 114*a*-114*c* toward the print substrate 102 traveling through a different position relative to the nozzles 116*a*-116*c* (e.g., above, below, horizontal, vertical, etc.).

Figure 2:
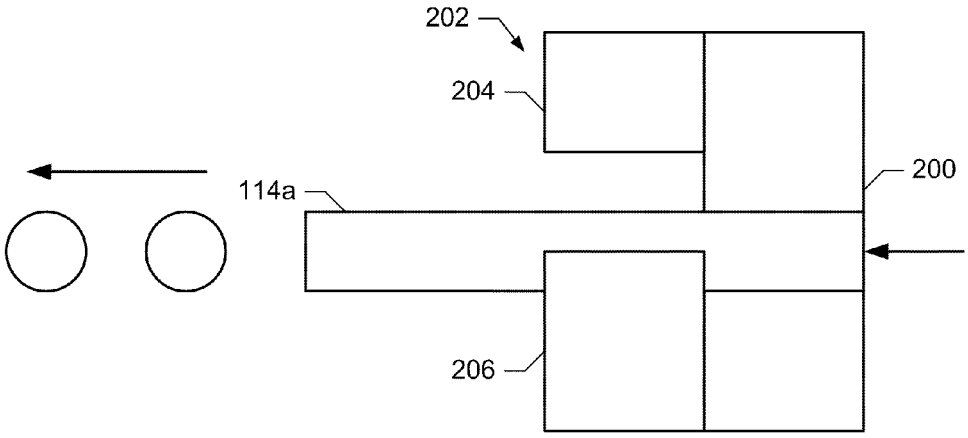
FIG. 2 is a side schematic view of an example continuous-jetting nozzle including a dielectrophoresis modulator constructed in accordance with the teachings of this disclosure.
Figure 3:
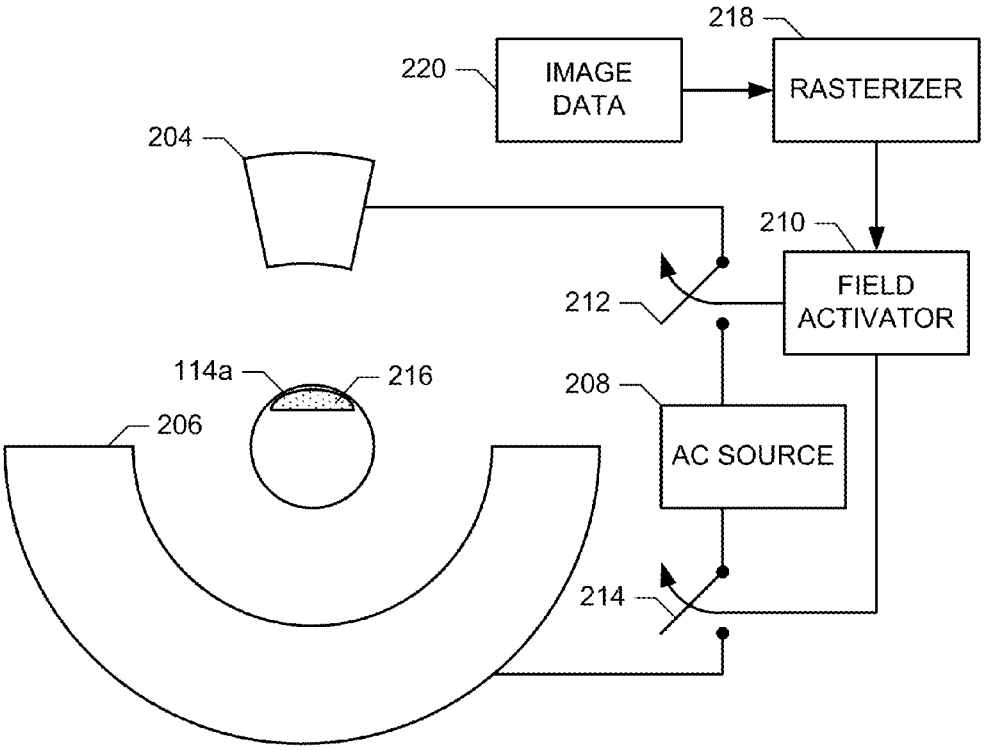
FIG. 3 is a top schematic view of the example continuous-jetting nozzle and the dielectrophoresis modulator of FIG. 2.

FIG. 2 is a side schematic view of an example continuous-jetting nozzle 200 including a dielectrophoresis modulator 202. The example nozzle 200 and the example dielectrophoresis modulator 202 may be used to implement any of the example nozzles 116*a*-116*c* and the respective example dielectrophoresis modulators 108*a*-108*c* of FIG. 1, respectively. As shown in FIG. 2, the example nozzle 200 generates a stream (e.g., the stream 114*a* of FIG. 1) of ink traveling from right to left. FIG. 3 is a top schematic view of the example continuous-jetting nozzle 200 and the dielectrophoresis modulator 202 of FIG. 2. The following description will refer to both views of the example nozzle 200 and the example modulator 202. Although the following description refers to the stream 114*a* and the nozzle 116*a*, it is to be understood that the same description applies to the other streams 114*b*, 114*c* and nozzles 116*b*, 116*c*.

The example dielectrophoresis modulator 202 includes two electrodes 204 and 206. As shown in FIG. 3, the example electrodes 204 and 206 are positioned on different sides of the stream 114*a* at similar, equal, or substantially equal distances from the stream 114*a*. The example electrodes 204 and 206 are coupled to an AC source 208, which generates an AC voltage between different terminals. In particular, the electrodes 204 and 206 are in circuit with different terminals of the AC source 208 so that the electrodes 204 and 206 have different electrical potentials. As a result, the electrodes 204 and 206 generate an alternating, non-uniform electrical field $\hat{E}$ consistent with the respective voltage and phase of the AC source 208 when the AC source 208 is activated (e.g., turned on) and is coupled to both electrodes.

A field activator 210 controls switching elements 212 and 214 to couple and/or decouple the respective electrodes 204 and 206 from the AC source 208. When the field activator 210 activates the alternating electrical field $\hat{E}$ (e.g., by closing or coupling the terminals of the switching elements 212 and 214, coupling the electrodes 204 and 206 to the AC source 208), the AC source 208 generates an alternating potential between the electrodes 204 and 206. A dielectrophoretic force $F_{DEP}$ 216 is applied to the stream 114*a* from the alternating electrical field $\hat{E}$. In particular, the dielectrophoretic force $F_{DEP}$ 216 corresponds to the gradient of the alternating electrical field $\hat{E}$.

Figure 4:
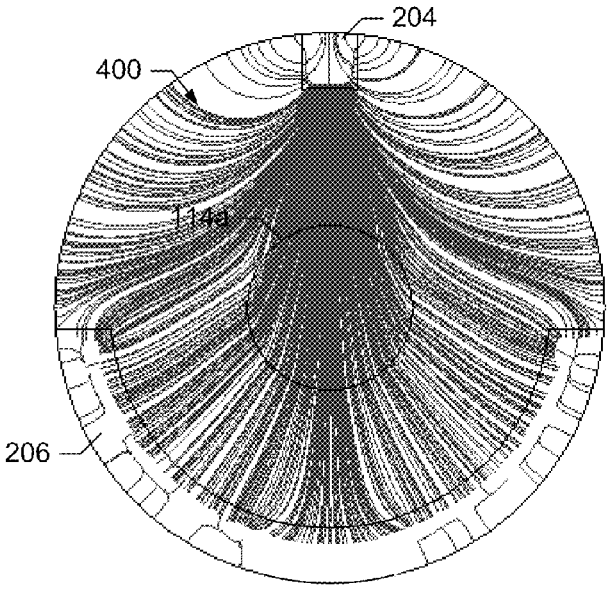
FIG. 4 illustrates a simulated electrical field generated by the example dielectrophoresis modulator of FIG. 2.

FIG. 4 illustrates a simulated electrical field $\hat{E}$ 400 generated by the example dielectrophoresis modulator 208 of FIG. 2. The example electrical field $\hat{E}$ 400 is illustrated using field lines illustrating the gradient of the electrical field $\hat{E}$ 400. As the gradient of the electrical field $\hat{E}$ 400 increases, the dielectrophoretic force $F_{DEP}$ applied to the stream 114*a* also increases. Therefore, electric fields with larger gradients allow for broader ranges of ink types that may be used by the printer 100 and/or a shorter length of the stream 114*a* prior to breaking into droplets. Shortening the length of the stream 114*a* may reduce the space between the nozzle 116*a* and the print substrate 102, thus reducing drop placement errors and increases print quality. The example electrodes 204 and 206 illustrated in FIG. 3 are sized and arranged to increase the gradient of the electrical field $\hat{E}$ 400. As illustrated in FIG. 4, a large portion of the electrical field $\hat{E}$ 400 passes through the stream 114*a* and converges at a portion of the stream 114*a* closer to the electrode 204.

While the example field activator 210 of FIGS. 2 and 3 toggles switching elements 212 and 214 to activate and/or deactivate the alternating electrical field, the field activator 210 may activate and/or deactivate the alternating electrical field using many different alternative and/or supplemental methods. For example, the field activator 210 may activate and/or deactivate the electrical power supply to the AC source 208.

The AC source 208 alternates the voltage applied to the electrodes 204 and 206 and, thus, the frequency of the alternating electric field $\hat{E}$, at a first frequency $\omega_1$. The frequency $\omega_1$ is selected based on the particular ink used by the printer 100. Thus, when the printer 100 changes ink, the AC source 208 may be adjusted to change the first frequency $\omega_1$ to apply an appropriate dielectrophoretic force $F_{DEP}$ to the stream 114*a*. The first frequency $\omega_1$ allows independence of the print quality and/or performance of the printer 100 from the inks used by the printer 100. Thus, the first frequency $\omega_1$ may be adjusted to maintain a substantially equal print quality between inks.

Figure 5:
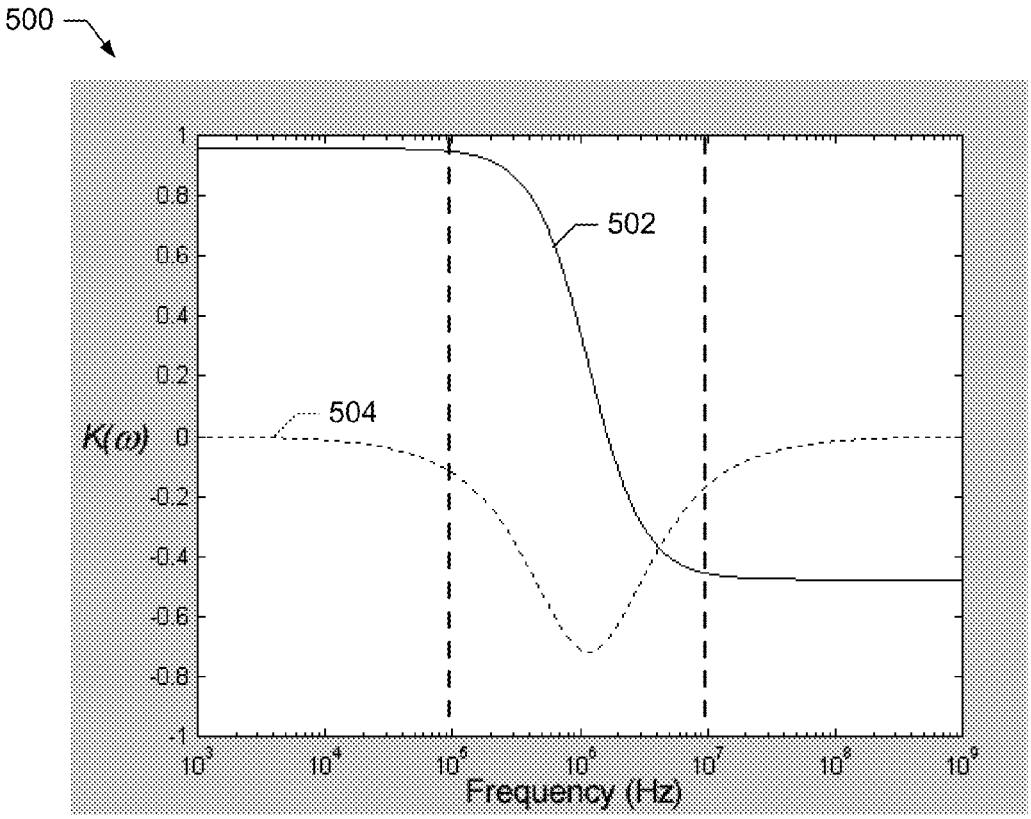
FIG. 5 is a graph illustrating the Clausius-Mossotti function of an example ink that may be used to determine the operating frequencies in accordance with the teachings of this disclosure.

In the illustrated example, the frequency $\omega_1$ is determined using the Clausius-Mossotti function ($K(\omega_1)$) of the selected ink. FIG. 5 is a graph illustrating the Clausius-Mossotti function 500 of an example ink that may be used to determine the operating frequency $\omega_1$ of the AC source 208. The example Clausius-Mossotti function 500 has a real part 502 and an imaginary part 504. The dielectrophoretic force $F_{DEP}$ applied to the stream 114*a* is based on the Clausius-Mossotti function $K(\omega_1)$ of the ink as shown in Equations 1 and 2. In Equation 1, $\in_0$ is the permittivity of the substantially continuous medium surrounding the stream 114*a* (e.g., air), R is the radius of the stream 114*a*, and $\hat{E}$ is the electrical field. In Equation 2, $\in$ is the permittivity of the ink used in the stream 114*a*, j is the imaginary number, and $\sigma$ is the conductivity of the ink used in the stream 114*a*.

$$F_{DEP} \approx \pi\varepsilon_0 R^3 \nabla(\hat{E}^2) Re\{\kappa(\varpi_1)\} \quad \text{Eq. 1}$$

$$\kappa(\varpi_1) \equiv \frac{\varepsilon - \varepsilon_0 - \frac{j\sigma}{\varpi_1}}{\varepsilon + 2\varepsilon_0 - \frac{j\sigma}{\varpi_1}} \quad \text{Eq. 2}$$

As shown in Equation 1, the dielectrophoretic force $F_{DEP}$ increases as the electrical field strength increases, as the electrical field $\hat{E}$ converges, and/or as the real part 502 of the Clausius-Mossotti function $K(\omega_1)$ 500 increases. As illustrated in FIG. 5, the real part 502 of the Clausius-Mossotti function $K(\omega_1)$ 500 is a function of the first frequency $\omega_1$ (e.g., an excitation frequency). While FIG. 5 illustrates an example frequency dependency of a particular ink, different inks may be designed and/or selected having different frequency dependencies. For example, the conductivity of an ink may be modified by adding and/or subtracting a charge reagent (e.g., a salt) to an ink. Additionally or alternatively, the Clausius-Mossotti function $K(\omega_1)$ may be determined and/or verified by measuring the conductivity $\sigma$ and permittivity $\in$ of the ink and/or the surrounding medium and applying Equation 2. The value of the first frequency $\omega_1$ may be selected based on the Clausius-Mossotti function $K(\omega_1)$ so that the dielectrophoretic force $F_{DEP}$ applied to the stream 114*a* is substantially equal independent of the selected ink.

Figure 6:
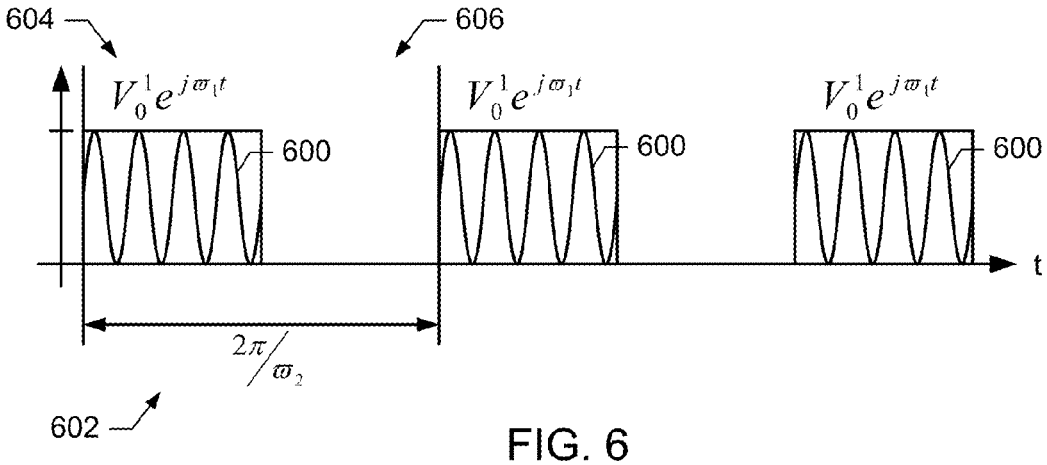
FIG. 6 illustrates an example waveform applied to the example electrodes of FIG. 3 to modulate a continuous ink stream into droplets.

FIG. 6 illustrates an example waveform 600 applied to the example electrodes 204 and 206 of FIG. 3 to modulate the example ink stream 114*a* into droplets. The waveform 600 is selectively activated and deactivated at a second frequency $\omega_2$. As illustrated in FIG. 6, the example waveform 600 is activated for a first portion 604 (e.g., the first half) of a period 602 $(2\pi)/\omega_2$, and is deactivated for a second portion 606 (e.g., the remainder) of the period 602 (e.g., the second half). When the waveform 600 is activated, the AC source 208 applies the alternating voltage to the electrodes 204 and 206 at the first frequency $\omega_1$, which causes the electrodes 204 and 206 to generate an alternating electric field $\hat{E}$.

The alternating electric field $\hat{E}$ applies a dielectrophoretic force $F_{DEP}$ to the stream 114*a* in accordance with Equations 3-5 below. The cylindrical stream 114*a* has a surface tension $\sigma_s$ around its outer surface. The dielectrophoretic force $F_{DEP}$ induces an interfacial pressure p' that may be estimated by integrating the Kelvin force density along the radial direction to obtain the dielectrophoretic pressure at the surface of the stream 114*a*. In Equation 3, p' is the dielectrophoretic-induced pressure, R is the radius of the stream 114*a*, and $V_0$ is the peak-peak amplitude of the AC voltage applied between the electrodes 204 and 206 by the AC source 208.

$$p' \approx \frac{(\varepsilon - \varepsilon_0)V_0^2}{2R^2} \quad \text{Eq. 3}$$

To understand the magnitude of the dielectrophoretic-induced pressure p', the change in the radius of the stream 114*a* is shown in Equations 4 and 5 by substantially equating or approximating the change in the surface tension of the stream 114*a* (which is the dominating pressure component of the stream 114*a*) with the dielectrophoretic-induced force p'. In Equations 4 and 5, $\sigma_s$ is the surface tension of the stream 114*a*, $\Delta r$ is the change in the radius of the stream 114*a* due to dielectrophoretic pressure, $R_1$ and $R_2$ are the principal radii of curvature of the stream 114*a* (e.g., where $\Delta r = R_1 - R_2$), and R is the steady-state radius of the stream 114*a*.

$$p' \approx \sigma_s\left(\frac{1}{R_1} - \frac{1}{R_2}\right) \approx \sigma_s \frac{\Delta r}{R^2} \quad \text{Eq. 4}$$

$$\Delta r \approx \frac{(\varepsilon - \varepsilon_0)V_0^2}{2\sigma_s} \quad \text{Eq. 5}$$

If, for example, the fluid in the stream 114*a* is water and the example operating voltage $V_0$ of the AC source 208 is 40 Volts (V), $\Delta r$ is about 7 microns. The radius change $\Delta r$ illustrates that the example dielectrophoretic-induced interfacial pressure p' is sufficient to trigger a breakup of the stream 114*a* into discrete droplets.

The second frequency $\omega_2$ determines the size of the droplets (e.g., the droplets 118*a*) that are generated from the stream 114*a*. According to Rayleigh instability theory, the droplet volume may be approximated using Equation 6. As shown in Equation 6, the droplet volume is inversely proportional to the second frequency $\omega_2$. Thus, the droplet size may be increased by decreasing the second frequency $\omega_2$ and/or decreased by increasing the second frequency $\omega_2$. In Equation 6, $\rho$ is the density of the fluid in the stream 114*a*, R is the steady-state radius of the stream 114*a*, and $\sigma_s$ is the surface tension of the stream 114*a*.

$$\text{drop_Volume} = \frac{2\pi^2\sqrt{\sigma_s R^3/\rho}}{\varpi_2} \quad \text{Eq. 6}$$

Returning to FIG. 3, the example continuous-jetting nozzle 200 further includes a rasterizer 218. The rasterizer 218 receives image data 220 (e.g., data representative of an image to be produced on the print substrate 102 of FIG. 1 using ink) and generates a raster from the image data 220. For example, the rasterizer 218 may generate data that includes sizes of desired ink droplets 118*a* to be deposited on the print substrate 102, the relative spacing of the ink droplets 118*a* on the substrate 102, and/or the timing of delivery of the ink droplets 118*a* to the print substrate 102. In some examples, the nozzle 200 deposits ink droplets 118*a* on a particular section of the print substrate 102, while additional nozzles deposit respective ink droplets on other sections of the print substrate 102. In such examples, the rasterizer 218 may coordinate timing data to align particular droplets 118*a* with those of parallel nozzles, preceding nozzles, and/or subsequent nozzles in a path of travel of the print substrate 102.

Figure 7:
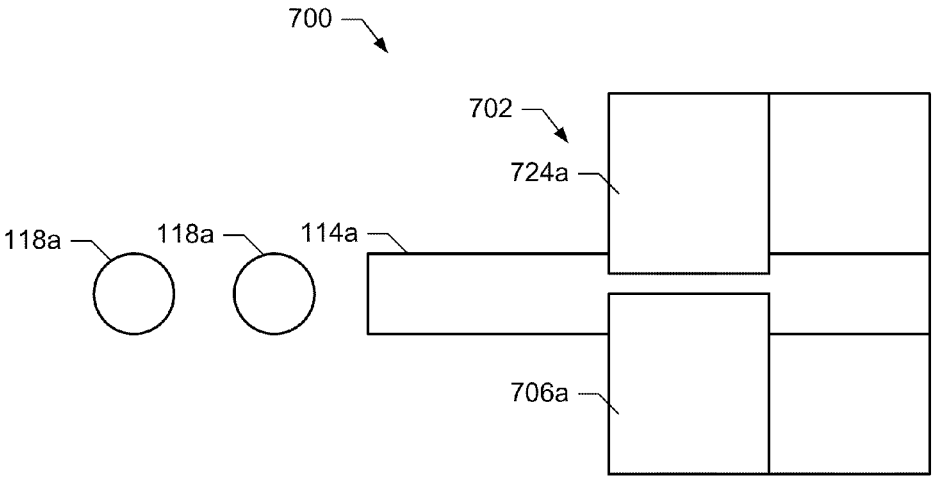
FIG. 7 is a side schematic view of another example continuous-jetting nozzle including another example dielectrophoresis modulator constructed in accordance with the teachings of this disclosure.
Figure 8:
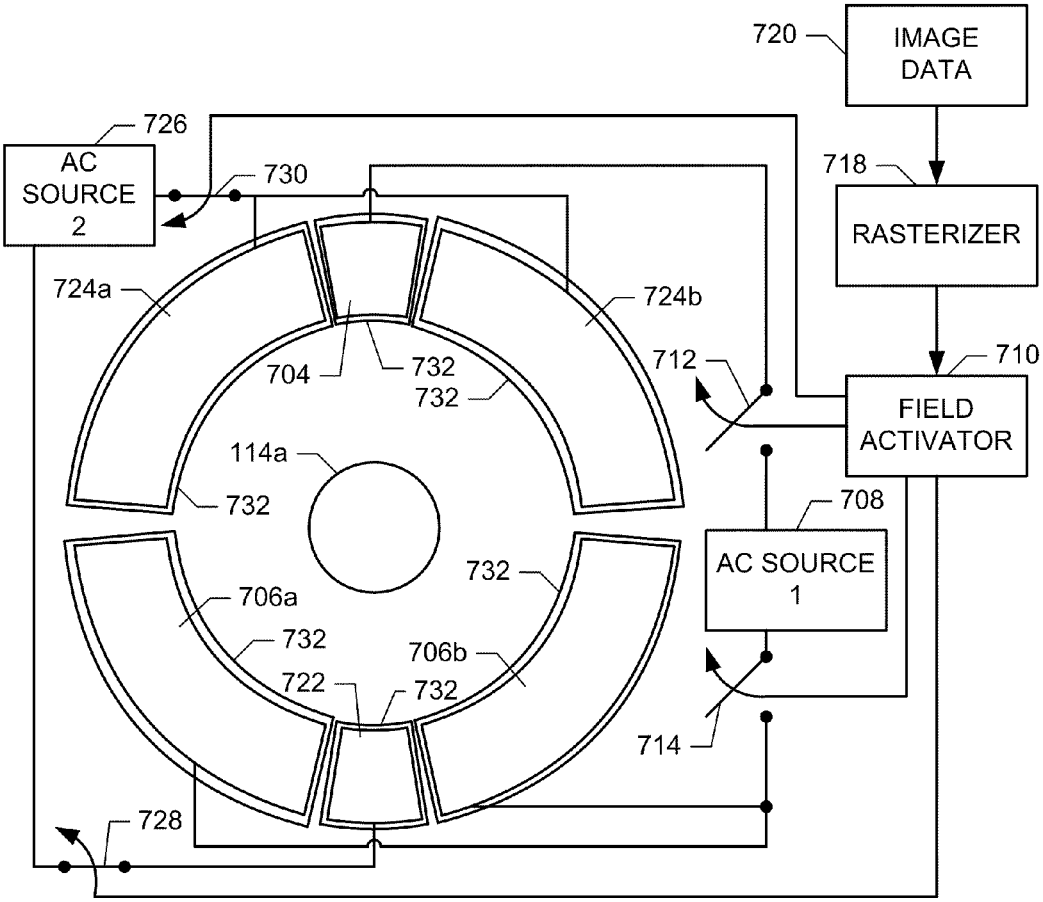
FIG. 8 is a top schematic view of the example continuous-jetting nozzle and the dielectrophoresis modulator of FIG. 7.

FIG. 7 is a side schematic view of another example continuous-jetting nozzle 700 including another example dielectrophoresis modulator 702. FIG. 8 is a top schematic view of the example continuous-jetting nozzle 700 and the dielectrophoresis modulator 702. Like the example dielectrophoresis modulator 202 of FIGS. 2 and 3, the example dielectrophoresis modulator 702 includes electrodes 704, 706*a* and 706*b*, a first AC source 708, a field activator 710, switching elements 712 and 714 and a rasterizer 718. However, unlike the dielectrophoresis modulator 202, the example modulator 702 of FIGS. 7 and 8 further includes second electrodes 722, 724*a* and 724*b*, a second AC source 726, and second switching elements 728 and 730.

The example electrodes 706*a* and 706*b* are similar to the example electrode 206 of FIG. 3, but are split into two electrodes 706*a* and 706*b* that are electrically connected. Thus, the electrodes 704, 706*a* and 706*b* generate a similar alternating electric field $\hat{E}$ as the electrodes 204 and 206. The electrodes 722, 724*a*, and 724*b* are geometrically similar or identical to the respective electrodes 704, 706*a*, and 706*b* but are located on different sides of the stream 114*a*. For example, the arrangement of the electrodes 722, 724*a*, and 724*b* may substantially mirror the arrangement of the electrodes 704, 706*a*, and 706*b*. The electrodes 722, 724*a*, and 724*b* are selectively coupled to the second AC source 726 to generate an alternating electrical field $\hat{E}$. Due to the different positioning of the electrodes 722, 724*a*, and 724*b* as compared to the electrodes 704, 706*a*, and 706*b*, the electrical field $\hat{E}$ generated by the electrodes 722, 724*a*, and 724*b* has a field gradient and, thus, a dielectrophoretic force $F_{DEP}$ in a direction different from that of the dielectrophoretic force $F_{DEP}$ generated by the electrodes 704, 706*a*, and 706*b*.

The example AC sources 708 and 726 may have substantially the same AC frequency $\omega_1$, AC phase, and activating frequency $\omega_2$. In some examples, the second AC source 726 may be omitted and the electrodes 722, 724*a*, and 724*b* may be selectively coupled to the AC source 708. The field activator 710 controls the switching elements 712, 714, 728, and 730 to activate one of the electrical fields at a time. When the switching elements 712 and 714 are closed (e.g., the electrodes 704, 706*a*, and 706*b* are coupled to the AC source 708), the switching elements 728 and 730 are open (e.g., the electrodes 722, 724*a*, and 724*b* are decoupled from the AC source 2). Conversely, when the switching elements 712 and 714 are open (e.g., the electrodes 704, 706*a*, and 706*b* are decoupled from the AC source 708), the switching elements 728 and 730 are closed (e.g., the electrodes 722, 724*a*, and 724*b* are coupled to the AC source 2). When the electrodes 704, 706*a*, 706*b*, 722, 724*a*, or 724*b* are decoupled from their respective AC sources 708 or 726, the electrodes 704, 706*a*, 706*b*, 722, 724*a*, and 724*b* are floating instead of grounded. Floating the electrodes 704, 706*a*, 706*b*, 722, 724*a*, and 724*b* increases the electrical field gradients.

Figure 9:
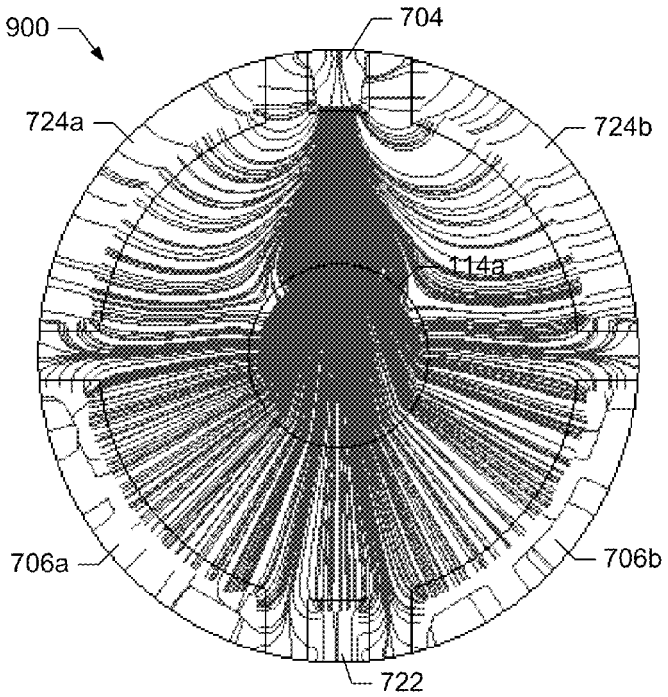
FIG. 9 illustrates a simulated electrical field generated by the example dielectrophoresis modulator of FIGS. 7 and 8.

FIG. 9 illustrates a simulated electrical field $\hat{E}$ 900 generated by the example dielectrophoresis modulator 702 of FIGS. 7 and 8. The example electrical field $\hat{E}$ 900 includes field lines present when the example electrodes 704, 706*a*, and 706*b* are coupled to the AC source 708 and the electrodes 722, 724*a*, and 724*b* are floating.

Figure 10A:
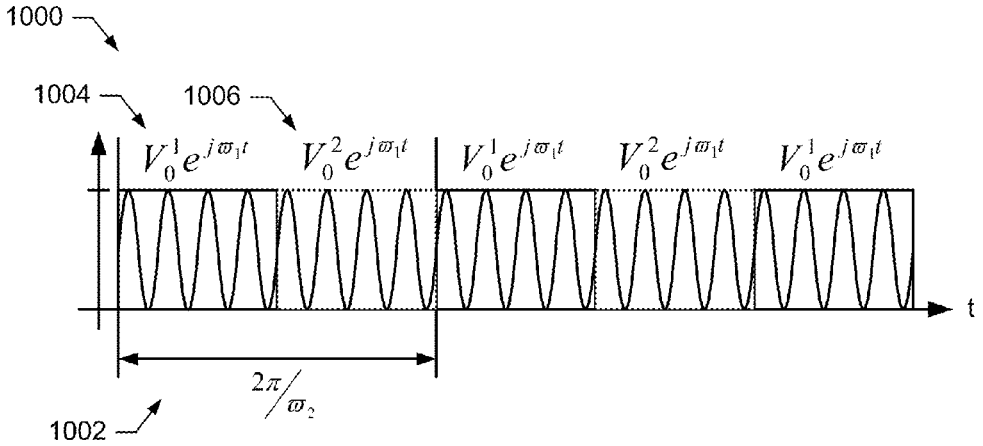
FIG. 10A illustrates an example waveform applied to the example electrodes of FIG. 8 to modulate a continuous ink stream into droplets.

FIG. 10A illustrates an example waveform 1000 applied to the example electrodes 704, 706*a*, 706*b*, 722, 724*a*, and 724*b* of FIG. 8 to modulate a continuous ink stream 114*a* into droplets 118*a*. The waveform 1000 has a period 1002 of $(2\pi)/\omega_2$, and each period 1002 has a first portion 1004 and a second portion 1006. During the first portion 1004, the electrodes 704, 706*a*, and 706*b* are coupled to the AC source 708 having a voltage amplitude $V_{01}$ to generate an alternating electrical field $\hat{E}$ having a frequency $\omega_1$. During the second portion 1006, the electrodes 722, 724*a*, and 724*b* are coupled to the AC source 726 having a voltage amplitude $V_{02}$ (which may be equal to the voltage amplitude $V_{01}$) to generate an alternating electrical field $\hat{E}$ having the frequency $\omega_1$.

Figure 10B:
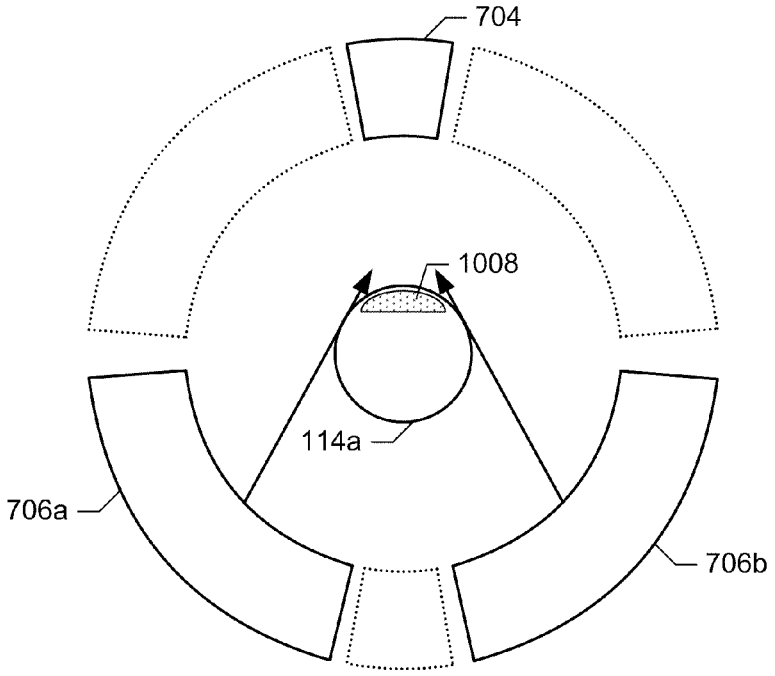
FIGS. 10B and 10C illustrate the example electrodes that are activated by the waveform of FIG. 10A.

FIG. 10B illustrates the example electrodes 704, 706*a*, and 706*b* when they are activated during the first portions 1004 of each period 1002 of the waveform 1000. During the first portions 1004, the electrodes 704, 706*a*, and 706*b* are coupled to the AC source 708 and generate an alternating electric field $\hat{E}$ at the first frequency $\omega_1$. The alternating electric field $\hat{E}$ applies a dielectrophoretic force $F_{DEP}$ 1008 on the stream 114*a* in a first direction. As described above, the dielectrophoretic force $F_{DEP}$ 1008 overcomes the surface tension $\sigma_s$ of the stream 114*a*. While the example electrodes 704, 706*a*, and 706*b* are activated, the other electrodes 722, 724*a*, and 724*b* are deactivated and are electrically floating.

Figure 10C:
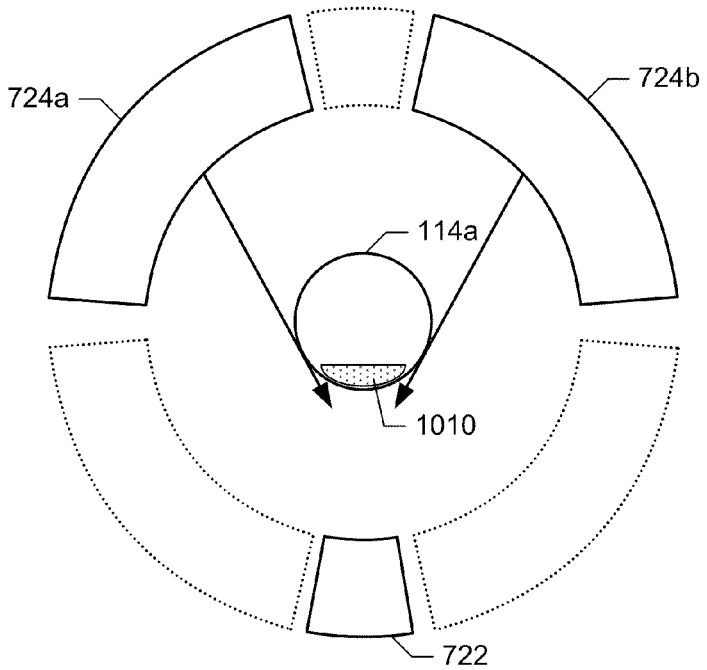

FIG. 10C illustrates the example electrodes 722, 724*a*, and 724*b* when they are activated during the second portions 1006 of each period 1002. During the second periods 1006, the electrodes 722, 724*a*, and 724*b* are coupled to the AC source to generate a second dielectrophoretic force $F_{DEP}$ 1010 in a second direction opposite the direction of the first dielectrophoretic force $F_{DEP}$ 1008.

Thus, the first and second dielectrophoretic forces $F_{DEP}$ 1008, 1010 alternate to break up the surface tension $\sigma_s$ of the stream 114*a*. Compared to the example dielectrophoretic modulator 202 of FIGS. 2 and 3, the example dielectrophoretic modulator 702 may break up the stream 114*a* into droplets a shorter time and/or distance after the stream 114*a* exits the nozzle 700. By decreasing the distance to generate the droplets, the nozzle 700 may be placed closer to a print substrate (e.g., the print substrate 102 of FIG. 1). As the nozzle 700 approaches the print substrate 102, the placement of the droplets 118*a* onto the print substrate 118*a* may be more accurate by reducing the susceptibility of the droplet path to airflows within the printer 100. A closer placement of the nozzle 700 to the print substrate 102 further allows for a higher production by the printer 100 because the ink stream 114*a* may have a higher velocity, a higher rate of ink droplets 118*a* and, thus, a faster print substrate throughput.

The example dielectrophoresis modulators 202 and 702 may be implemented using, for example, micro-electromechanical systems (MEMS) technologies. In particular, MEMS are capable of handling the example voltages and frequencies used to modulate the ink streams into droplets as described herein. Using MEMS to implement the dielectrophoresis modulators 202 or 702, the example printer 100 may place the nozzles 116*a*-116*c*, the example dielectrophoresis modulators 108*a*-108*c*, and/or the example droplet deflectors 110*a*-110*c* closer to the substrate and/or to each other than they may be placed using other technologies. Higher nozzle densities allow for higher-resolution print images and higher-quality prints. Other technologies may alternatively be used to achieve higher and/or lower nozzle densities, operating voltages, and/or operating frequencies as desired for a particular application.

Some example electrode geometries are presented in FIGS. 3 and 8. However, other electrode geometries may be used. Electrode geometries may be configured to increase the dielectrophoretic force $F_{DEP}$ applied to the stream 114*a*. For example, a stream of ink having a different cross-section than the example stream 114*a* may have a different electrode geometry to increase the dielectrophoretic force $F_{DEP}$.

While in some examples the ink is a water-based ink, non-polar solvent based inks, such as Isopar-based inks, may have a higher electrode operating voltage $V_0$. The dielectrophoretic force $F_{DEP}$ is linearly proportional to $(\in-\in_0)(V_0)^2$. Isopar-based inks have permittivity around $3*\in_0$. To achieve the same dielectrophoretic forces $F_{DEP}$ as with water, the applied voltage is raised by a factor of sqrt(79/2)=6.3. Thus, if the reference applied voltage $V_0$ is 40V for water-based inks, then the operating voltage is about 250V to work with Isopar based inks. To reduce the possibility of dielectric breakdown when such high voltages (250V) are employed, the electrodes spaced L meters apart may be coated with a dielectric layer 732 having a thickness δ and a permittivity of $\in_\delta$. The electric field strength $E_\delta$ inside the dielectric layer 732 may be expressed using Equation 7.

$$E_\delta = \frac{V}{\left\{\frac{\varepsilon_\delta}{\varepsilon_m}(L-\delta)+2\delta\right\}} \quad \text{Eq. 7}$$

Using a set of example numbers (V=250V; L=50 μm, the ratio between the permittivity $\in_\delta$ of the dielectric layer 732 and that of the air is about 3), $E_\delta$ is less than 2 MV/m as long as the thickness δ of the dielectric layer 732 is between 2 μm to 20 μm. Many dielectric materials have breakdown field strengths on the order of 10 MV/m. Thus, a 250V voltage amplitude may be used at the electrodes. For example, Teflon may be used to implement the dielectric layer 732 due to its relatively high breakdown field strength. Additionally, Teflon may be either spin-coated or, using a chemical vapor deposition process, may be integrated into the standard MEMS thin film process. In some other examples, the dielectric layer 732 may have a higher or lower thickness δ to accommodate the space(s) or gap(s) between the active electrodes (e.g., the electrodes 704, 706*a*, and 706*b* during the first portion 1004 of the period 1002, or the electrodes 722, 724*a*, and 724*b* during the second portion 1006 of the period 1002) and the passive (e.g., floating) electrode (e.g., the electrodes 704, 706*a*, and 706*b* during the second portion 1006 of the period 1002, or the electrodes 722, 724*a*, and 724*b* during the first portion 1004 of the period 1002). It is recommended to limit the lower bound of this gap dimension (therefore the largest dimension of the arch electrode) by the maximum electric field strength that may short the dielectric layer 732.

Figure 11:
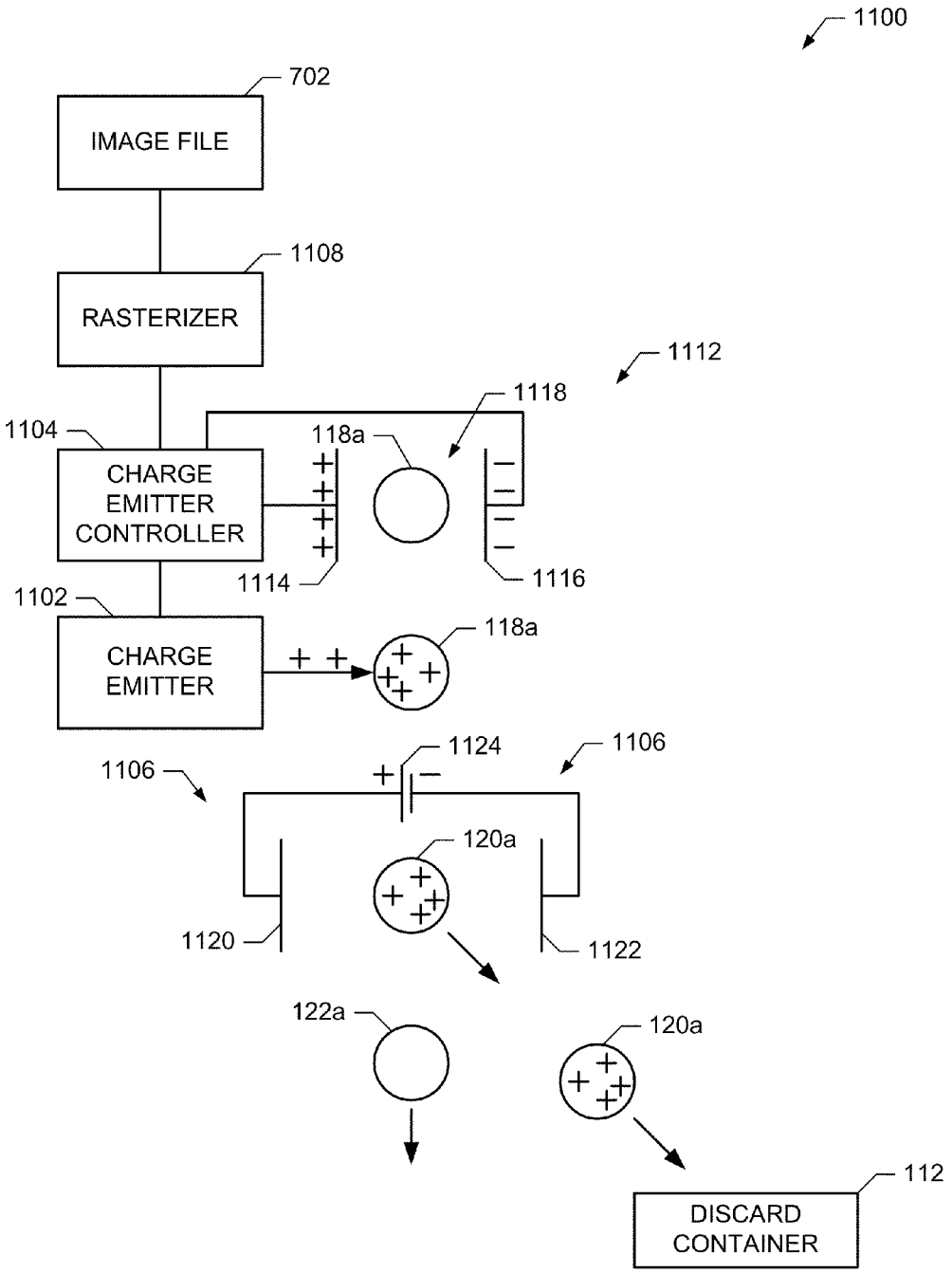
FIG. 11 is a schematic diagram of an example droplet deflector constructed in accordance with the teachings of this disclosure.

FIG. 11 is a schematic diagram of an example droplet deflector 1100. The droplet deflector 1100 may be used, for example, to implement the droplet deflectors 110*a*-110*c* of FIG. 1. In the interest of brevity, the description of the deflector 1100 will refer to the deflector 110*a*. However, it is to be understood that the same description applies to deflectors 110*b* and 110*c*. The example droplet deflector 1100 illustrated in FIG. 11 includes a charge emitter 1102, a charge emitter controller 1104, and a charge deflector 1106. In general, the droplet deflector 1100 selectively charges ink droplets (e.g., the droplets 118*a* of FIG. 1) that are generated from an ink stream (e.g., the ink stream 114*a* of FIG. 1) in accordance with a desired image to be produced on a print substrate (e.g., the print substrate 102 of FIG. 1) and deflects the charged droplets 120*a* to prevent the charged droplets 120*a* from reaching the print substrate 102.

The example charge emitter 1102 selectively generates and delivers positive charges to ink droplets 118*a*. The charge emitter 1102 may be implemented using any type of positive or negative charge emitter, and is illustrated in FIG. 11 as a positive charge emitter. The charge emitter 1102 selectively emits positive charges to positively charge an ink droplet 118*a* as directed by the charge emitter controller 1104. The charge emitter controller 1104 controls the charge emitter 1102 based on image data provided by a rasterizer 1108. The rasterizer 1108 receives an image file (e.g., the image data 220 and/or 720 of FIGS. 2 and/or 7) representative of at least a portion of a desired image. In implementations where the nozzles 116*a*-116*c* are stationary and the print substrate 102 travels below the nozzles 116*a*-116*c*, the rasterizer 1108 may provide only the data corresponding to the portion of the image to be produced on the print substrate 102 in the path of the ink stream 114*a* and/or the non-deflected ink droplets 122*a*. When the charge emitter controller 1104 determines, based on the raster data, that an ink droplet 118*a* is to be deflected, the charge emitter controller 1104 directs the charge emitter 1102 to emit charges (in the illustrated example, positive charges) to charge the ink droplet 118*a*.

To determine the timing of charge emission, the charge emitter controller 1104 may use the raster data, the timing of the droplets 118*a* traveling from the nozzle 116*a*, and/or feedback data from a droplet sensor. To this end, the example droplet deflector 1100 further includes a capacitive droplet sensor 1112 in communication with the charge emitter controller 1104. The capacitive droplet sensor 1112 includes two oppositely-charged plates 1114 and 1116 that generate an electrical field $\hat{E}$ within a detection area 1118. The electrical field $\hat{E}$ is dependent on the permittivity of the detection area 1118, and the capacitive droplet sensor 1112 detects changes in the electrical charges on the plates 1114 and 1116, which correspond to changes in the electrical field $\hat{E}$ and, thus, changes in the permittivity of the detection area 1118. For example, the detection area 1118 has a first permittivity when no ink droplets 118*a* are present in the detection area 1118. When an ink droplet 118*a* traverses the detection area 1118, the permittivity of the detection area 1118 changes, which causes a change in the charge on the plates 1114 and 1116. The change in the charge on the plates 1114 and 1116 corresponds to the size of the droplet 118*a* in the detection area 1118. The charge emitter controller 1104 detects changes in the charge on the plates 1114 and 1116 and compares the detections to the times when droplets 118*a* are expected to pass through the detection area 1118. The detected changes in the charge on the plates 1114 and 1116 may additionally or alternatively be translated into the size of the detected droplet, which may be compared to an expected size of the droplet 118*a* in the detection area 1118.

After the droplets 118*a* are charged (becoming charged droplets 120*a*), the droplets 120*a* travel by the charge deflector 1106. The example charge deflector 1106 includes multiple charged electrodes 1120 and 1122. The charged electrodes 1120 and 1122 may be charged by, for example, a battery 1124 or other power source. In the case of the positively charged droplet 120*a* of FIG. 11, the positively-charged electrode 1120 exerts a repellant force on the droplet 120*a* while the negatively-charged electrode 1122 exerts an attractive force on the droplet 120*a*. The forces applied by the charged electrodes 1120 and 1122 deflect the charged droplets 120*a* from their original paths and into a discard container (e.g., the discard container 112 of FIG. 1). The charge applied to the droplet 120*a* by the charge emitter 1102, the distance between the path of the droplet 120*a* and the charged electrodes 1120 and 1122, and/or the strength of the charge on the charged electrodes 1120 and 1122 may be configured to deflect the charge a desired distance to direct the charged droplets 120*a* into the discard container 112.

Although an example droplet deflector 1100 is described and shown in FIG. 11, the droplet deflector 110*a*, 110*b*, 110*c* of FIGS. 1 and/or 11 may be implemented using any other droplet selection and/or deflection method or device compatible with the example dielectrophoretic modulators 108*a*-108*c* described herein. Additionally, the example droplet deflector 1100 may be used with other types of droplets modulation methods and apparatus.

While example manners of implementing the example printer 100 of FIG. 1 has been illustrated in FIGS. 2, 3, 7, 8, 10, and 11, one or more of the elements, processes and/or devices illustrated in FIGS. 2, 3, 7, 8, 10, and 11 may be combined, divided, re-arranged, omitted, eliminated and/or implemented in any other way. Further, the example AC sources 202, 702, and 726, the example field activators 210 and 710, the example rasterizers 218, 718, and 1108, the example charge emitter controller 1104 and/or, more generally, the example dielectrophoretic modulators 200 and 700 and/or the example droplet deflector 1100 of FIGS. 2, 3, 7, 8, 10, and 11 may be implemented by hardware, software, firmware and/or any combination of hardware, software and/or firmware. Thus, for example, any of, the example AC sources 202, 702, and 726, the example field activators 210 and 710, the example rasterizers 218, 718, and 1108, the example charge emitter controller 1104 and/or, more generally, the example dielectrophoretic modulators 200 and 700 and/or the example droplet deflector 1100 of FIGS. 2, 3, 7, 8, 10, and 11 could be implemented by one or more circuit(s), programmable processor(s), application specific integrated circuit(s) (ASIC(s)), programmable logic device(s) (PLD(s)) and/or field programmable logic device(s) (FPLD(s)), MEMS device(s), etc.

Further still, the example AC sources 202, 702, and 726, the example field activators 210 and 710, the example rasterizers 218, 718, and 1108, the example charge emitter controller 1104 and/or, more generally, the example dielectrophoretic modulators 200 and 700 and/or the example droplet deflector 1100 of FIGS. 2, 3, 7, 8, 10, and 11 may include one or more elements, processes and/or devices in addition to, or instead of, those illustrated in FIGS. 2, 3, 7, 8, 10, and 11, and/or may include more than one of any or all of the illustrated elements, processes and devices.

Figure 12A:
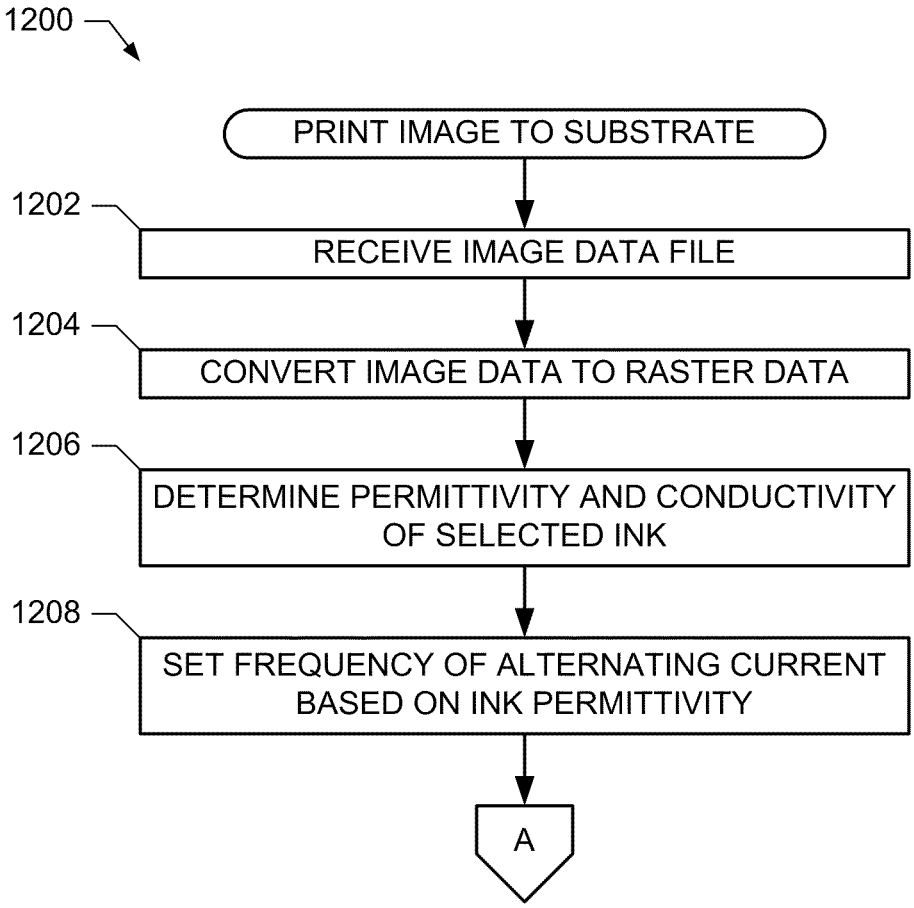
FIGS. 12A and 12B show a flowchart representative of example machine readable instructions to print an image to a substrate in accordance with the teachings of this disclosure.
Figure 12B:
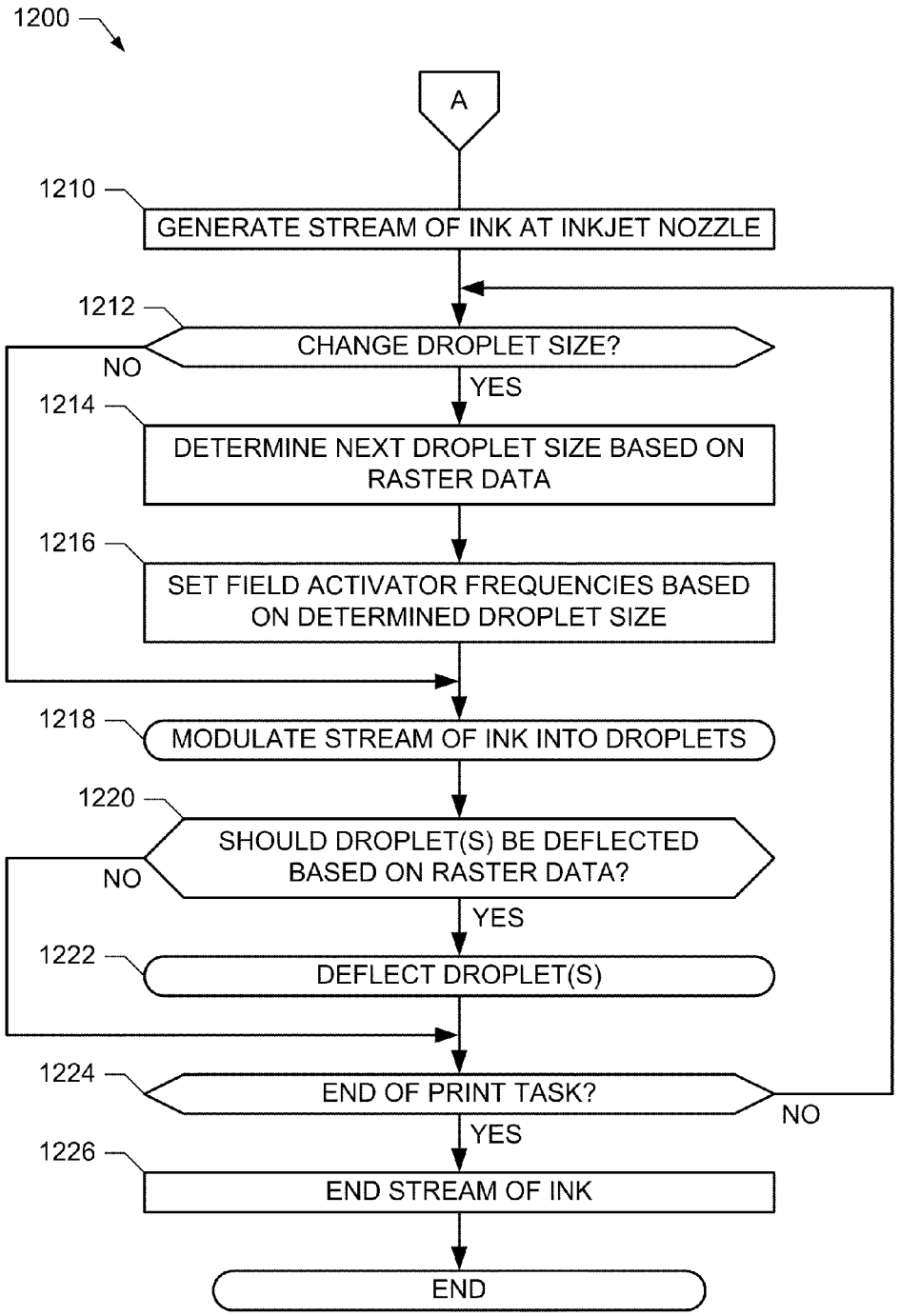
Figure 13:
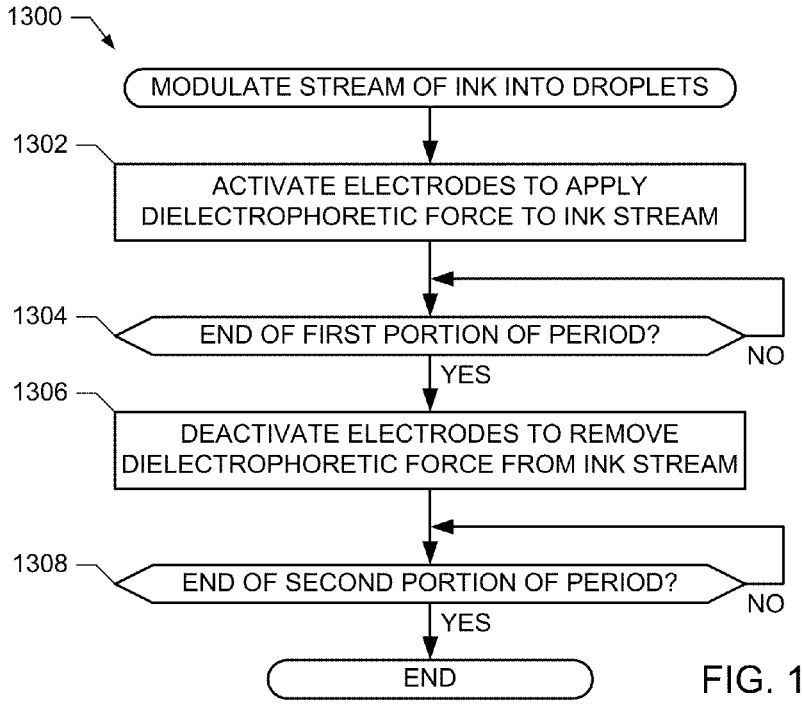
FIG. 13 is a flowchart representative of example machine readable instructions to modulate a stream of ink into droplets in accordance with the teachings of this disclosure.
Figure 14:
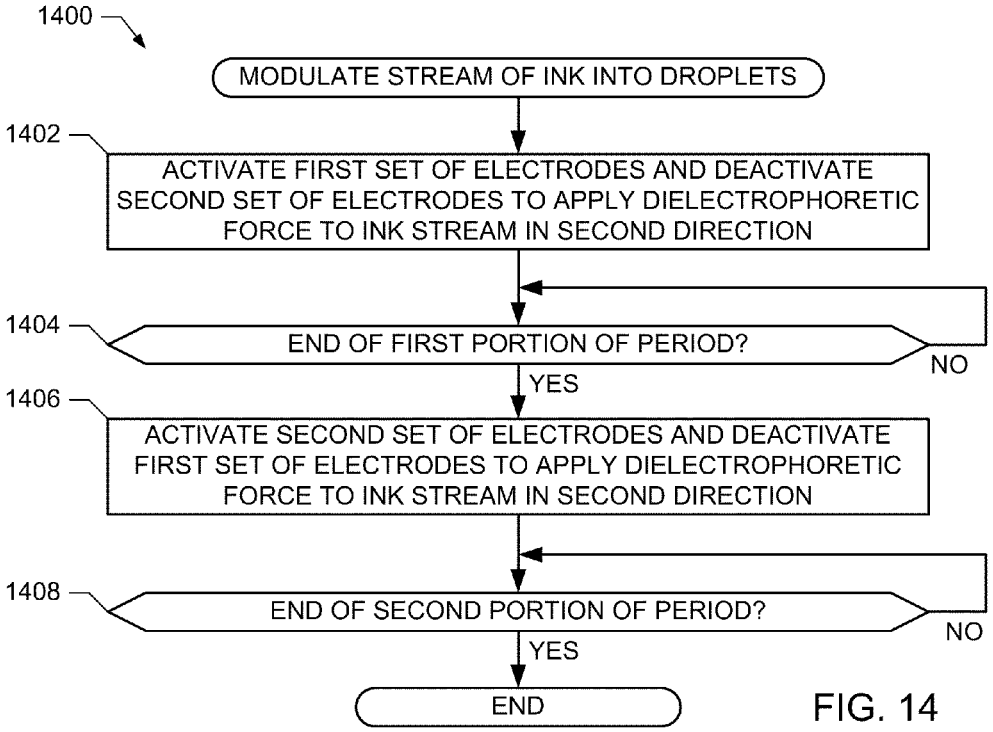
FIG. 14 is a flowchart representative of example machine readable instructions to modulate a stream of ink into droplets in accordance with the teachings of this disclosure.
Figure 15:
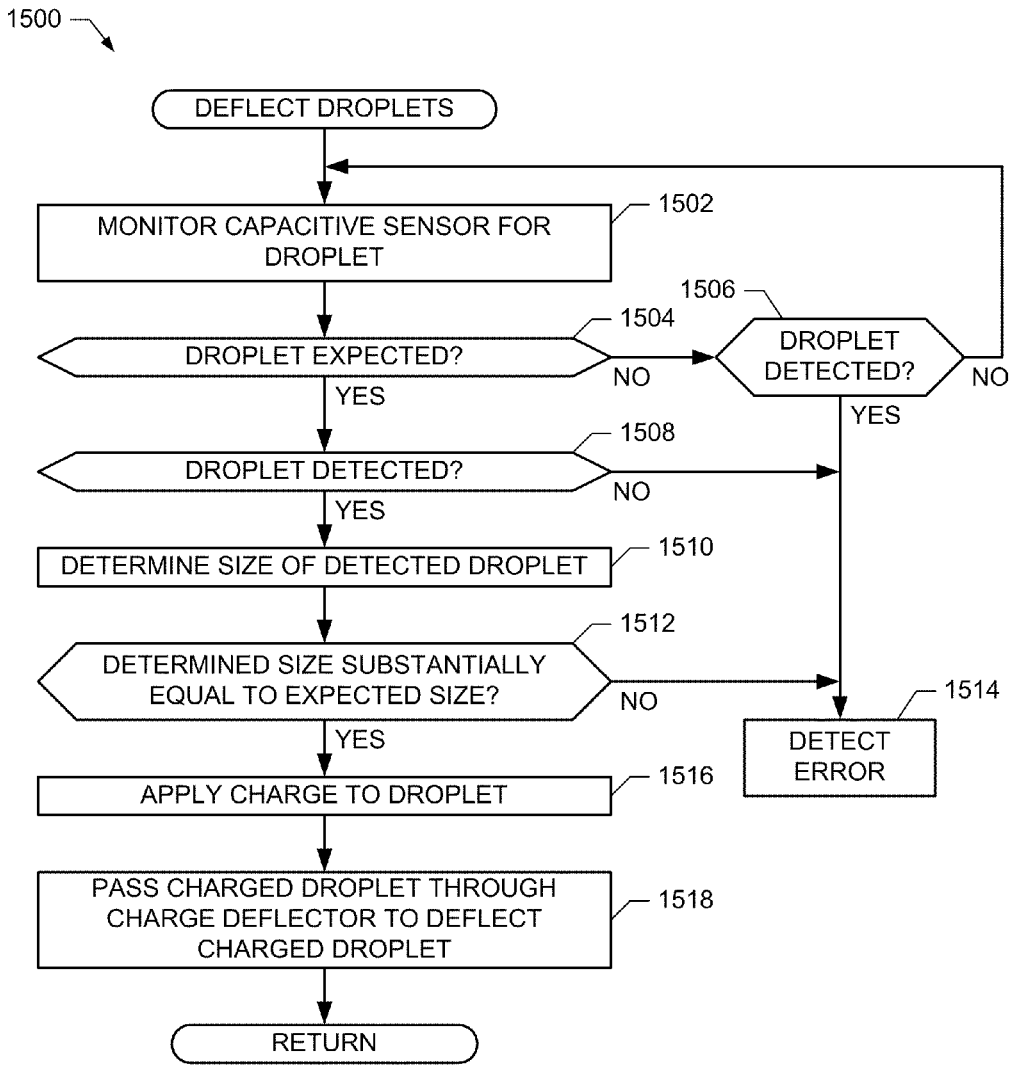
FIG. 15 is a flowchart representative of example machine readable instructions to alter a trajectory of a selected droplet in accordance with the teachings of this disclosure.

FIGS. 12A and 12B show a flowchart representing example machine readable instructions 1200 which may be executed to print an image to a print substrate. The example machine readable instructions 1200 may be executed by the example printer 100 of FIG. 1 to print a desired image to a print substrate 102. FIGS. 13-15 show flowcharts representing example machine readable instructions 1300, 1400, and 1500 which may be executed to implement respective ones of blocks 1218 and 1222. While the example machine readable instructions 1200, 1300, 1400, and 1500 of FIGS. 12A, 12B, and 13-15 are described with respect to the example dielectrophoretic modulator 108*a*, the example droplet detector 110*a*, the example ink stream 114*a*, the example nozzle 116*a*, and the example droplets 118*a*, 120*a*, and 122*a*, the example instructions 1200, 1300, 1400, and 1500 are equally applicable to the example dielectrophoretic modulators 108*b* and 108*c*, the example droplet detectors 110*b* and 110*c*, the example ink streams 114*b* and 114*c*, the example nozzles 116*b* and 116*b*, and/or the example droplets 118*b*, 118*c*, 120*b*, 120*c*, 122*b*, and 122*c*.

Turning to FIG. 12A, the example instructions 1200 begins when an image data file is received (block 1202). The image data file may include, for example, digital data representative of an image including any of one or more ink colors and/or grayscale ink, vector data, pixel data, and/or any other type of data associated with printing an image. The printer 100 (e.g., via the rasterizer 202 or 702 of FIG. 2 or 7) converts the received image data to raster data (block 1204). The raster data may include data representative of the desired image that has been translated from the image data into data representing a series of ink droplets to be arranged on the print substrate 102 to produce the image. In some examples, the raster data is arranged according to the droplets to be applied to the print substrate by individual continuous-jet ink nozzles.

The printer 100 then determines a permittivity and a conductivity of a selected ink to be applied to the print substrate 102 (block 1206). In some examples, the printer 100 may determine the permittivity and/or conductivity empirically. However, in some examples the permittivity and/or the conductivity of the ink may be known and/or calculated and provided to the printer 100 and/or retrieved from a look up table. Based on the permittivity of the selected ink, the printer 100 sets the AC frequency $\omega_1$ of one or more AC sources (e.g., the AC sources 208, 708, or 726).

Turning to FIG. 12B, the printer 100 (e.g., via the piezoelectric ink pump 106) generates a substantially continuous stream 114*a* of ink at the inkjet nozzle 116*a* (block 1210). In some examples, the printer 100 begins generating the stream of ink when a print task begins and stops generating the stream of ink when the print task ends to reduce waste ink or reduce energy consumption. A field activator (e.g., the field activator 210 or 710 of FIG. 3 or 8) determines whether to change the droplet size (block 1212). The example field activator 210 determines whether to change the droplet size based on the raster data. If the field activator 210 determines that the droplet size is to be changed (block 1212), the field activator 210 determines the next droplet size based on the raster data (block 1214). The field activator 210 then changes the field activator frequency $\omega_2$ according to the determined droplet size (block 1216).

After changing the droplet size (block 1216) or determining that the droplet size should not be changed (block 1212), the dielectrophoretic modulator 202 or 702 modulates the stream 114*a* of ink into discrete droplets 118*a* (block 1218). Example methods to modulate the stream 114*a* of ink may be dependent on the configuration of the dielectrophoretic modulator 202 or 702 and are described below with reference to FIGS. 13 and 14.

During or after modulation of the stream 114*a* of ink into discrete droplets 118*a*, the example printer 100 determines whether one or more droplets 118*a* should be deflected (e.g., via the droplet deflector 110*a*) based on the raster data (block 1220). If one or more droplets 118*a* should be deflected (block 1220), the droplet deflector 110*a* deflects the droplet(s) (e.g., directs the droplets to the discard container 112) (block 1222). After deflecting the droplet(s) 120*a* (block 1222) or after determining that the droplet(s) 118*a* should not be deflected (block 1220), the example printer 100 determines whether the print job has ended (block 1224). If the print job has not ended (block 1224), control returns to block 1212 to determine whether the droplet size should be changed, to modulate the stream 114*a* of ink into discrete droplets 118*a*, and/or to deflect the droplets 118*a*. If the print job has ended (block 1224), the piezoelectric pump 106 ends the stream of ink (block 1226) and the example instructions 1200 end. The example instructions 1200 may additionally or alternatively iterate for another print task.

While the example instructions 1200 have been shown and described in a linear fashion, any one or more of the example blocks 1212-1224 may be performed concurrently to size, modulate, and/or deflect different discrete droplets 118*a*. In some examples, blocks 1218-1222 may be performed in a linear fashion with respect to a particular discrete droplet 118*a* but simultaneously with respect to different discrete droplets 118*a* due to the time and space traversed by the ink from exiting the nozzle 116*a* in the stream 114*a*, being subjected to the dielectrophoretic forces $F_{DEP}$ to modulate the stream 114*a* into the discrete droplets 118*a*, and/or reaching the droplet deflector 110*a* to potentially be deflected.

FIG. 13 is a flowchart representative of example machine readable instructions 1300 which may be executed to modulate a stream 114*a* of ink into discrete droplets 118*a*. The example instructions 1300 may be used to implement block 1218 of FIG. 12B using the example dielectrophoretic modulator 202 of FIGS. 2 and 3. To modulate a stream 114*a* of ink into discrete droplets 118*a*, the dielectrophoretic modulator 202 (e.g., via the field activator 210 of FIG. 3) activates the electrodes 204 and 206 to apply a dielectrophoretic force (e.g., the dielectrophoretic force $F_{DEP}$ 216 of FIG. 3) to the stream 114*a* of ink (block 1302). For example, the field activator 210 may couple the electrodes 204 and 206 to the AC source 208 via the switching elements 212 and 214, causing the AC source 208 to apply an alternating voltage to the electrodes 204 and 206. The electrodes 204 and 206 apply the dielectrophoretic force $F_{DEP}$ while they are activated. The example field activator 210 then determines whether a first portion 604 of a period (e.g., the period 602 of FIG. 6) is ended (block 1304). If the first portion 604 of the period 602 is not ended (block 1304), control continues to loop through block 1304 while the electrodes 204 and 206 remain activated.

When the first portion 604 of the period 602 is ended (block 1304), the field activator 210 deactivates the electrodes 204 and 206 to remove the dielectrophoretic force $F_{DEP}$ from the stream 114*a* of ink (block 1306). The field activator 210 may deactivate the electrodes 204 and 206 by, for example, opening the switching elements 212 and 214 to decouple the electrodes from the AC source 208, thereby cutting off the electrical field. Removing the dielectrophoretic force $F_{DEP}$ from the stream 114*a* allows the surface tension $\sigma_s$ of the ink to reshape the stream 114*a*, causing a ripple at the outer surface of the stream 114*a* and continuing the process of breaking up the stream 114*a* into the discrete droplets 118*a*.

The example field activator 210 then determines whether a second portion 606 of the period 602 is ended (block 1308). If the second portion 606 of the period 602 is not ended (block 1308), control loops through block 1308 while the electrodes 204 and 206 remain deactivated. When the second portion 606 of the period 602 is ended (block 1308), the example instructions 1300 end and control returns to block 1220 of FIG. 12B. In some examples, the instructions 1300 may iterate to generate a series of discrete droplets.

FIG. 14 is a flowchart representative of example instructions 1400 which may be executed to modulate a stream 114*a* of ink into discrete droplets 118*a*. The example instructions 1400 may be used to implement block 1218 of FIG. 12B using the example dielectrophoretic modulator 702 of FIGS. 7 and 8. To modulate a stream 114*a* of ink into discrete droplets 118*a*, the dielectrophoretic modulator 702 (e.g., via the field activator 710 of FIG. 8) activates a first set of electrodes 704, 706*a*, and 706*b* and deactivates a second set of electrodes 722, 724*a*, and 724*b* to apply a dielectrophoretic force (e.g., the dielectrophoretic force $F_{DEP}$ 1008 of FIG. 10B) to the stream 114*a* of ink in a first direction (block 1402). For example, the field activator 710 may couple the electrodes 704, 706*a*, and 706*b* to the AC source 708 via the switching elements 712 and 714 and decouple the electrodes 722, 724*a*, and 724*b* from the AC source 726 via the switching elements 728 and 730, causing the AC source 208 to apply an alternating voltage to the electrodes 704, 706*a*, and 706*b*. The electrodes 704, 706*a*, and 706*b* apply the dielectrophoretic force $F_{DEP}$ while they are activated. The example field activator 710 then determines whether a first portion 1004 of a period (e.g., the period 1002 of FIG. 6) is ended (block 1404). If the first portion 1004 of the period 1002 is not ended (block 1404), control continues to loop through block 1404 while the electrodes 704, 706*a*, and 706*b* remain activated and the electrodes 722, 724*a*, and 724*b* remain deactivated.

When the first portion 1004 of the period 1002 is ended (block 1404), the field activator 710 deactivates the first set of electrodes 704, 706*a*, and 706*b* and activates the second set of electrodes 722, 724*a*, and 724*b* to apply the dielectrophoretic force to the stream 114*a* of ink in a second direction (e.g., the dielectrophoretic force $F_{DEP}$ 1010 of FIG. 10C) (block 1406). The field activator 710 may deactivate the electrodes 704, 706*a*, and 706*b* by opening the switching elements 712 and 714 to decouple the electrodes form the AC source 708 and may activate the electrodes 722, 724*a*, and 724*b* by closing the switching elements 728 and 730 to couple the electrodes 722, 724*a*, and 724*b* to the AC source 726. Changing the direction of the dielectrophoretic force $F_{DEP}$ 1010 causes the stream 114*a* to break up more rapidly than if the surface tension $\sigma_s$ of the ink in the stream 114*a* acted on the shape of the stream. The alternating dielectrophoretic forces $F_{DEP}$ 1008 and 1010 cause a ripple at the outer surface of the stream 114*a* and continue the process of breaking up the stream 114*a* into the discrete droplets 118*a*.

The example field activator 710 then determines whether a second portion 1006 of the period 1002 is ended (block 1408). If the second portion 1006 of the period 1002 is not ended (block 1408), control continues to loop through block 1408 while the electrodes 722, 724*a*, and 724*b* remain activated and the electrodes 704, 706*a*, and 706*b* remain deactivated. When the second portion 1006 of the period 1002 is ended (block 1408), the example instructions 1400 end and control returns to block 1220 of FIG. 12B. In some examples, the instructions 1400 iterate to generate a series of discrete droplets.

FIG. 15 is a flowchart representative of example machine readable instructions 1500 which may be executed to deflect a droplet 118*a* of ink. The example instructions 1500 may be executed to implement block 1222 of FIG. 12B using the example droplet deflector 1100 of FIG. 11. The example droplet deflector 1100 includes the capacitive droplet sensor 1112 coupled to the charge emitter controller 1104. The example instructions 1500 begin after determining that one or more droplets 118*a* should be deflected (block 1220 of FIG. 12B).

The charge emitter controller 1104 monitors, via the capacitive droplet sensor 1112, for an ink droplet 118*a* (block 1502). The charge emitter controller 1104 determines whether an ink droplet 118*a* is expected in the detection area 1118 (block 1504). For example, the charge emitter controller 1104 may determine whether a droplet 118*a* is expected and a size of the expected droplet 118*a* based on raster data, information regarding the status of the dielectrophoretic modulator 108*a*, and/or data regarding a status of the nozzle 116*a*. If a droplet 118*a* is not expected (block 1504), the charge emitter controller 1104 determines whether a droplet 118*a* is detected by the capacitive droplet sensor 1112 (block 1506). If a droplet 118*a* is not detected (block 1506), control returns to block 1502 to continue monitoring the charge emitter controller 1104.

If the charge emitter controller 1104 determines at block 1504 that a droplet 118*a* is expected (block 1504), the charge emitter controller 1104 determines whether a droplet 118*a* is detected by the capacitive droplet sensor 1112 (block 1508). If a droplet 118*a* is detected (block 1508), the example charge emitter controller 1104 determines a size of the detected droplet 118*a* (block 1510). In some examples, the charge emitter controller 1104 determines the size of the droplet 118*a* by determining or measuring a change in the charge in the plates 1114 and 1116 of the capacitive droplet sensor 1112 and translating the change in the charge into a droplet size. The example charge emitter controller 1104 then determines whether the detected size of the droplet 118*a* is equal or substantially equal to an expected size (block 1512). The expected size may be based on, for example, raster data from the rasterizer 1108.

If a droplet is not expected (block 1504) but a droplet 118*a* is detected (block 1506), if a droplet is expected (block 1504) but a droplet is not detected (block 1508), and/or if a determined droplet size is not substantially equal to the expected size (block 1512), the charge emitter controller 1104 determines that an error has occurred (block 1514).

If a droplet is expected (block 1504), a droplet is detected (block 1508), and the determined size of the droplet 118*a* is substantially equal to the expected size (block 1512), the charge emitter controller 1104 directs the charge emitter 1102 to apply a charge to the droplet 118*a* (block 1516). The charged droplet 120*a* then passes through the charge deflector 1106, which deflects the charged droplet 120*a* (block 1518). The example instructions 1500 then end and control passes to block 1224 of FIG. 12B. In some other examples, the instructions 1500 may iterate to deflect additional droplets 118*a*.

Figure 16:
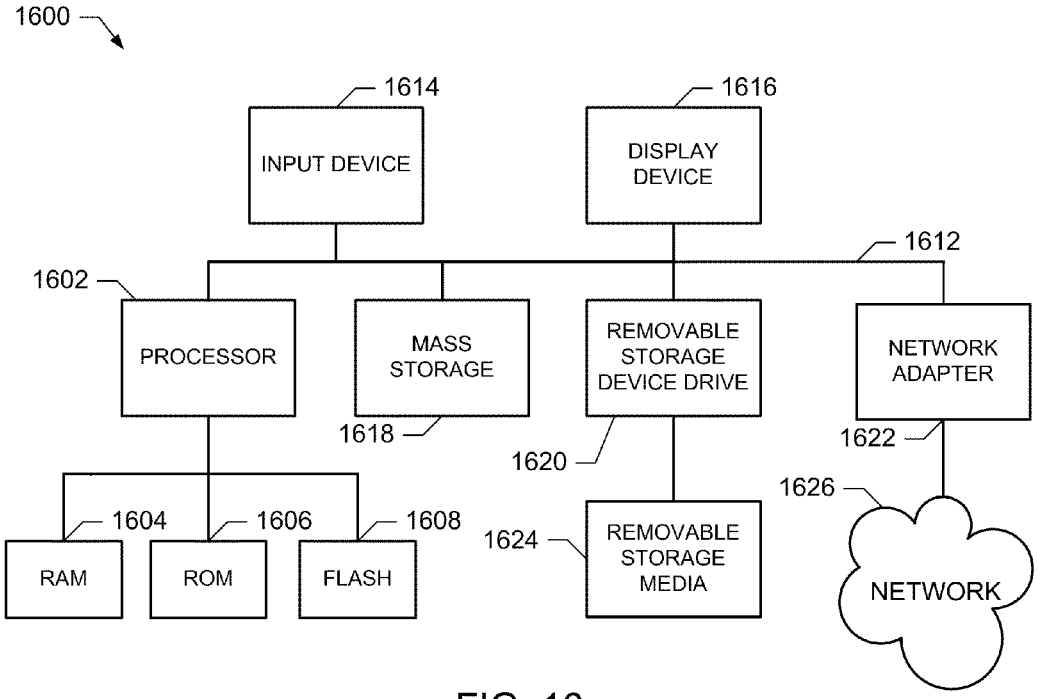
FIG. 16 is a diagram of an example processor system that may be used to execute the example machine readable instructions.

FIG. 16 is a diagram of an example processor system 1600 that may be used to execute the example machine readable instructions 1200, 1300, 1400, and 1500 described in FIGS. 12A, 12B, and 13-15, as well as to implement the printer 100 described in FIG. 1. The example processor system 1600 includes a processor 1602 having associated memories, such as a random access memory (RAM) 1604, a read only memory (ROM) 1606 and a flash memory 1608. The processor 1602 is coupled to an interface, such as a bus 1612 to which other components may be interfaced. In the illustrated example, the components interfaced to the bus 1612 include an input device 1614, a display device 1616, a mass storage device 1618, a removable storage device drive 1620, and a network adapter 1622. The removable storage device drive 1620 may include associated removable storage media 1624 such as magnetic or optical media. The network adapter 1622 may connect the processor system 1600 to an external network 1626.

The example processor system 1600 may be, for example, a conventional desktop personal computer, a notebook computer, a workstation or any other computing device. The processor 1602 may be any type of processing unit, such as a microprocessor from the Intel® Pentium® family of microprocessors, the Intel® Itanium® family of microprocessors, and/or the Intel XScale® family of processors. The memories 1604, 1606 and 1608 that are coupled to the processor 1602 may be any suitable memory devices and may be sized to fit the storage demands of the system 1600. In particular, the flash memory 1608 may be a non-volatile memory that is accessed and erased on a block-by-block basis.

The input device 1614 may be implemented using a keyboard, a mouse, a touch screen, a track pad, a barcode scanner or any other device that enables a user to provide information to the processor 1602.

The display device 1616 may be, for example, a liquid crystal display (LCD) monitor, a cathode ray tube (CRT) monitor or any other suitable device that acts as an interface between the processor 1602 and a user. The display device 1616 as pictured in FIG. 8 includes any additional hardware required to interface a display screen to the processor 1602.

The mass storage device 1618 may be, for example, a conventional hard drive or any other magnetic, optical, or solid state media that is readable by the processor 1602.

The removable storage device drive 1620 may, for example, be an optical drive, such as a compact disk-recordable (CD-R) drive, a compact disk-rewritable (CD-RW) drive, a digital versatile disk (DVD) drive or any other optical drive. It may alternatively be, for example, a magnetic media drive and/or a solid state universal serial bus (USB) storage drive. The removable storage media 1624 is complimentary to the removable storage device drive 1620, inasmuch as the media 1624 is selected to operate with the drive 1620. For example, if the removable storage device drive 1620 is an optical drive, the removable storage media 1624 may be a CD-R disk, a CD-RW disk, a DVD disk or any other suitable optical disk. On the other hand, if the removable storage device drive 1620 is a magnetic media device, the removable storage media 1624 may be, for example, a diskette or any other suitable magnetic storage media.

The network adapter 1622 may be, for example, an Ethernet adapter, a wireless local area network (LAN) adapter, a telephony modem, or any other device that allows the processor system 1600 to communicate with other processor systems over a network. The external network 1626 may be a LAN, a wide area network (WAN), a wireless network, or any type of network capable of communicating with the processor system 1600. Example networks may include the Internet, an intranet, and/or an ad hoc network.

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. An ink stream modulator, comprising:

an ink pump to generate a stream of ink through an inkjet nozzle;

a dielectrophoretic ink stream modulator comprising an electric field generator and first and second electrodes;

the electric field generator to generate a dielectrophoretic effect to modulate the stream of ink into a plurality of droplets, the electric field generator comprising:

the first and second electrodes distributed at respective points near the nozzle, such that at least a portion of the stream traverses between the first and second electrodes, and the first and second electrodes generate an alternating electrical field having a first frequency based on a permittivity of the ink, the first and the second electrodes modulate the stream of ink into the plurality of droplets when the electric field generator generates the dielectrophoretic effect.

2. An ink stream modulator as defined in claim 1, further comprising an additional electrical field generator coupled to third and fourth electrodes to generate a second alternating electrical field.

3. An ink stream modulator as defined in claim 2, wherein the first and second electrodes are positioned to cause a first dielectrophoretic force on the stream in a first direction and the third and fourth electrodes are positioned to cause a second dielectrophoretic force on the stream in a second direction different than the first direction.

4. An ink stream modulator as defined in claim 3, further comprising a field activator to selectively activate the alternating electrical field at a second frequency different than the first frequency.

5. An ink stream modulator as defined in claim 4, wherein a size of the droplets corresponds to the second frequency.

6. An ink stream modulator as defined in claim 4, further comprising a rasterizer to determine the second frequency based on data representative of a desired image.

7. A method to generate droplets from an ink stream, comprising:

generating a stream of ink with an inkjet nozzle;

modulating the stream of ink into a plurality of droplets by generating an alternating electrical field having a first frequency based on a permittivity of the ink to cause a dielectrophoretic effect.

8. A method as defined in claim 7, further comprising changing an ink type of the ink stream to a second ink type having a second permittivity, modifying the first frequency based on the second permittivity substantially maintain a print quality from the first ink type to the second ink type.

9. A method as defined in claim 7, further comprising deflecting one or more of the droplets based on data representative of an image.

10. A method as defined in claim 7, wherein the alternating electrical field has a first frequency, and modulating comprises selectively activating the alternating electrical field at a second frequency different than the first frequency.

11. A method as defined in claim 10, further comprising increasing the second frequency to decrease the size of the droplets.

12. A method as defined in claim 10, further comprising decreasing the second frequency to increase the size of the droplets.

13. A method as defined in claim 7, wherein the dielectrophoretic effect applies a dielectrophoretic force on the stream in a first direction.

14. A method as defined in claim 13, further comprising generating a second alternating electrical field to apply a second dielectrophoretic force on the stream in a direction different from the first direction.

15. A method as defined in claim 14, further comprising activating the second alternating electrical field when the first alternating electrical field is deactivated, and activating the first alternating electrical field when the second electrical field is deactivated.

16. An ink jet printer, comprising:

a print substrate feeder to cause a print substrate to traverse below a print bar;

an ink pump to generate a stream of ink through an inkjet nozzle toward the print substrate;

a dielectrophoretic ink stream modulator comprising first and second electrodes located at different points around an expected ink stream path, the electrodes to generate a dielectrophoretic force to modulate the stream into droplets; and a droplet deflector to change a trajectory of one or more of the droplets.

17. An ink jet printer as defined in claim 16, further comprising a droplet detector to detect one or more of the droplets, to compare a droplet detection time to an expected droplet time, and to detect an error when the droplet detection time is different than the expected droplet time.

18. An ink jet printer as defined in claim 16, further comprising a droplet detector to detect a size of one or more of the droplets, to compare a detected droplet size to an expected droplet size, and to detect an error when the detected droplet size is different than the expected droplet size.

19. An ink jet printer as defined in claim 16, wherein the droplet deflector deflects one or more of the ink droplets based on raster data representative of an image to be printed on the print substrate.

20. An ink jet printer as defined in claim 16, wherein the droplet deflector comprises:

a raster engine to determine one or more droplets to be deflected based on image data representative of an image;

a charge emitter to charge one or more of the determined droplets to be deflected; and a charge deflector to exert a force on the charged droplets to change a direction of the charged droplets.

* * * * *